US005646362A

United States Patent [19]

Koyama et al.

[11] Patent Number: 5,646,362

[45] Date of Patent: Jul. 8, 1997

[54] SOUND PARAMETER EDITING DEVICE FOR AN ELECTRONIC MUSICAL INSTRUMENT

[75] Inventors: Masahiro Koyama; Takuro Sone, both of Hamamatsu; Iwao Higashi, Shimonoseki, all of Japan

[73] Assignee: Yamaha Corporation, Japan

[21] Appl. No.: 605,455

[22] Filed: Feb. 26, 1996

Related U.S. Application Data

[63] Continuation of Ser. No. 135,157, Oct. 12, 1993, abandoned.

[30] Foreign Application Priority Data

Oct. 12, 1992 [JP] Japan ..... 4-298191
Dec. 10, 1992 [JP] Japan ..... 4-330504

[51] Int. Cl.[6] ..... G10H 1/18; G10H 7/00

[52] U.S. Cl. ..... 84/615; 84/653; 395/2.87

[58] Field of Search ..... 84/600, 622, 615, 84/628, 653, 656, 659; 395/154, 158, 160; 364/419.17

[56] References Cited

U.S. PATENT DOCUMENTS 5,153,829 10/1992 Furuya et al. ..... 84/622 X
5,220,117 6/1993 Yamada et al. ..... 84/600
5,300,727 4/1994 Osuga et al. ..... 84/622
5,331,111 7/1994 O'Connell ..... 84/602
5,388,264 2/1995 Tobias, II et al. .
5,391,827 2/1995 Koyama ..... 84/600

FOREIGN PATENT DOCUMENTS 3-269591 12/1991 Japan .

*Primary Examiner*—John W. Cabeca
*Assistant Examiner*—Jeffrey W. Donels
*Attorney, Agent, or Firm*—Graham & James LLP

[57] ABSTRACT

When sound parameters defining a selected element among plural elements constituting a sound are edited, a predetermined schematic display of the entire elements constituting the sound is made and, also, a particular part of the schematic display corresponding to the selected element in a special form is made about the selected element for emphasizing it. An operator can thereby recognize easily for which part of element in the entire sound structure he is currently making the parameter editing. In response to designation of a desired object of editing by the operator, plural possible candidates of edition processings corresponding to the designated object are displayed. Upon selection of one of the plural processings by the operator, the selected editing processing is automatically performed.

17 Claims, 20 Drawing Sheets

TONE SYNTHESIZING CIRCUIT 6

SOUND PARAMETER EDITING DEVICE FOR AN ELECTRONIC MUSICAL INSTRUMENT

This is a continuation of application Ser. No. 08/135,157 filed on Oct. 12, 1993, now abandoned.

BACKGROUND OF THE INVENTION

This invention relates to an electronic musical instrument capable of editing sound parameters by monitoring a display screen such as a liquid crystal panel and thereby setting and changing tone color etc. of a musical tone.

Further, this invention relates to an electronic musical instrument capable of synthesizing various musical tones by variously changing data such as parameters and, more particularly, to an editing device of an electronic musical instrument for performing editing of data including changing of data setting.

There is a known electronic musical instrument which can set a filter characteristic which imparts tone color change to a waveform signal and an envelope shape which imparts an envelope to a waveform by using various sound parameters and can provide a variety of tone colors by changing these sound parameters. These sound parameters are stored in a memory for each tone color and a tone color of a tone to be sounded is determined by reading sound parameters of a selected tone color from the memory and imparting them to respective parts of a tone source.

For changing set sound parameters, i.e., editing sound parameters in the known electronic musical instrument, types and values of sound parameters are displayed in parallel on a display screen such as a liquid crystal panel and an editing operation is made by changing the sound parameter values displayed on the display screen.

In the known electronic musical instrument, however, numerous parameters are displayed on the display screen and it is difficult to find out object parameters to be edited from among the numerous parameters. If an arrangement is made to individually display parameters with respect to each part of a tone source and thereby display only parameters of a part which is currently to be edited, the number of parameters which are displayed at a time will be reduced. This arrangement, however, will make it difficult to understand relation between the currently edited part of the tone source and the remaining part of the tone source with the result that inconvenience in the editing work remains.

On the other hand, recently developed electronic musical instruments can synthesize not only tones of natural musical instruments and human voice but also other various tones which cannot be produced by natural musical instruments. By selectively setting suitable parameters matching a music piece performed from among numerous parameters defining tone colors, envelopes and effects of musical tones, the player can cause the electronic musical instrument to synthesize a desired tone corresponding to the selectively set parameters.

There has recently been the tendency that the number of parameters set in an electronic musical instrument is constantly increasing. Therefore, for producing, for example, plural tone colors in an electronic musical instrument, there is an increasing demand for editing of parameters such as reading desired parameters from a storing medium storing parameters and setting the read out parameters in an electronic musical instrument, and exchanging parameters between an electronic musical instrument and a storing medium. There is also a case where it is necessary to copy parameters set in an electronic musical instrument to other storing medium or the like.

In prior art electronic musical instruments, an editing operation has been made by previously selecting an editing operation mode for editing parameters etc. (e.g., a swap mode for exchanging data, a copy mode for copying data and a delete mode for deleting data) and thereafter designating parameters which will become an object of the selected operation mode.

In a case, for example, where desired parameters are to be copied from a storing medium, the editing mode is first set to a copy mode and then parameters to be copied are designated in the storing medium and a position to which the parameters are to be copied is designated in the electronic musical instrument whereby parameters are copied from the storing medium to the electronic musical instrument.

In the known electronic musical instrument, therefore, an actual editing operation has to be made only after selecting a desired operation mode and it is troublesome to select and set a desired editing operation mode.

Further, in performing a copy editing operation in the known electronic musical instrument, a series of operations from "copy" to "data in region A" to "to region B" has to be made against a flow of thought from "data in region A" to "to region B" to "copy" and this makes it difficult to casually perform a copy editing operation according to an operator's flow of thoght.

SUMMARY OF THE INVENTION

It is, therefore, an object of the invention to provide an editing device which, in an electronic musical instrument capable of changing a characteristic of a tone generated from a tone source device, facilitates editing of sound parameters by editing parameters of elements constituting a tone source on the basis of display information on a display screen.

It is another object of the invention to provide a data editing device of an electronic musical instrument capable of performing an editing operation according to an operator's flow of thought.

For achieving the above described objects of the invention, a sound parameter editing device for an electronic musical instrument comprises a display device, editing means for selecting an element from among plural elements constituting a sound, and for editing sound parameters which define the selected element, and display control means for controlling said display device so that, when editing of the sound parameters of the selected element is made by the editing means, a predetermined schematic display of the entire elements constituting the sound is performed and a particular part of the schematic display corresponding to the selected element is performed in a special display form for emphasizing the selected element.

According to the invention, while the sound parameters of the selected element are edited, a predetermined schematic display of the entire elements constituting the sound is made and, as to the selected element, a corresponding part of the schematic display in a special form for emphasizing it is made and, accordingly, the operator can readily recognize for which part of elements of the entire sound structure he is making editing of parameters whereby the sound parameter edition can be facilitated.

For achieving the above described objects of the invention, a data editing device for an electronic musical instrument comprises designation means for designating an object of editing, display means for displaying possible plural edition processings in correspondence to the object designated by said designation means, selection means for selecting one of the displayed editing processings, and execution means for executing the edition processing selected by said selection means with respect to said object designated by said designation means.

When the operator has designated a desired object of editing, possilbe plural candidates of edition processing are automatically displayed in accordance with the designated object. Upon selecting a desired one from among the displayed candidates, the selected editing processing is executed.

For example, in an editiing operation of "data A", "to data region B", "copying", by designating "data region A" and "data region B" by the designation means, the display means displays candidates of plural possible processings between the two data such as "copying data", "exchanging data" etc. Upon selection of one of the candidates of plural processings by the selection means, the selected processing is executed with respect to the object designated by the designation means. When, for example, "copying data" has been selected by the selection means, a series of processings for "copying data in the region A to the region B" is executed. Accordingly, the operator may, in performing the copy editing operation, perform a series of operation according to the flow of thought from "data in the region A" to "to the region B" to "copying" and, therefore, an operation according to his feeling can be readily made. The display means has only to display a candidate corresponding to the object designated by the designation means and not all processings as in the known electronic musical instrument and so selection of a processing can also be facilitated.

Preferred embodiments of the invention will be described below with reference to the acocmpanying drawings.

BRIEF DESCRIPTION OF THE DRAWINGS

In the accompanying drawings.

DESCRIPTION OF PREFERRED EMBODIMENTS

Figure 1:
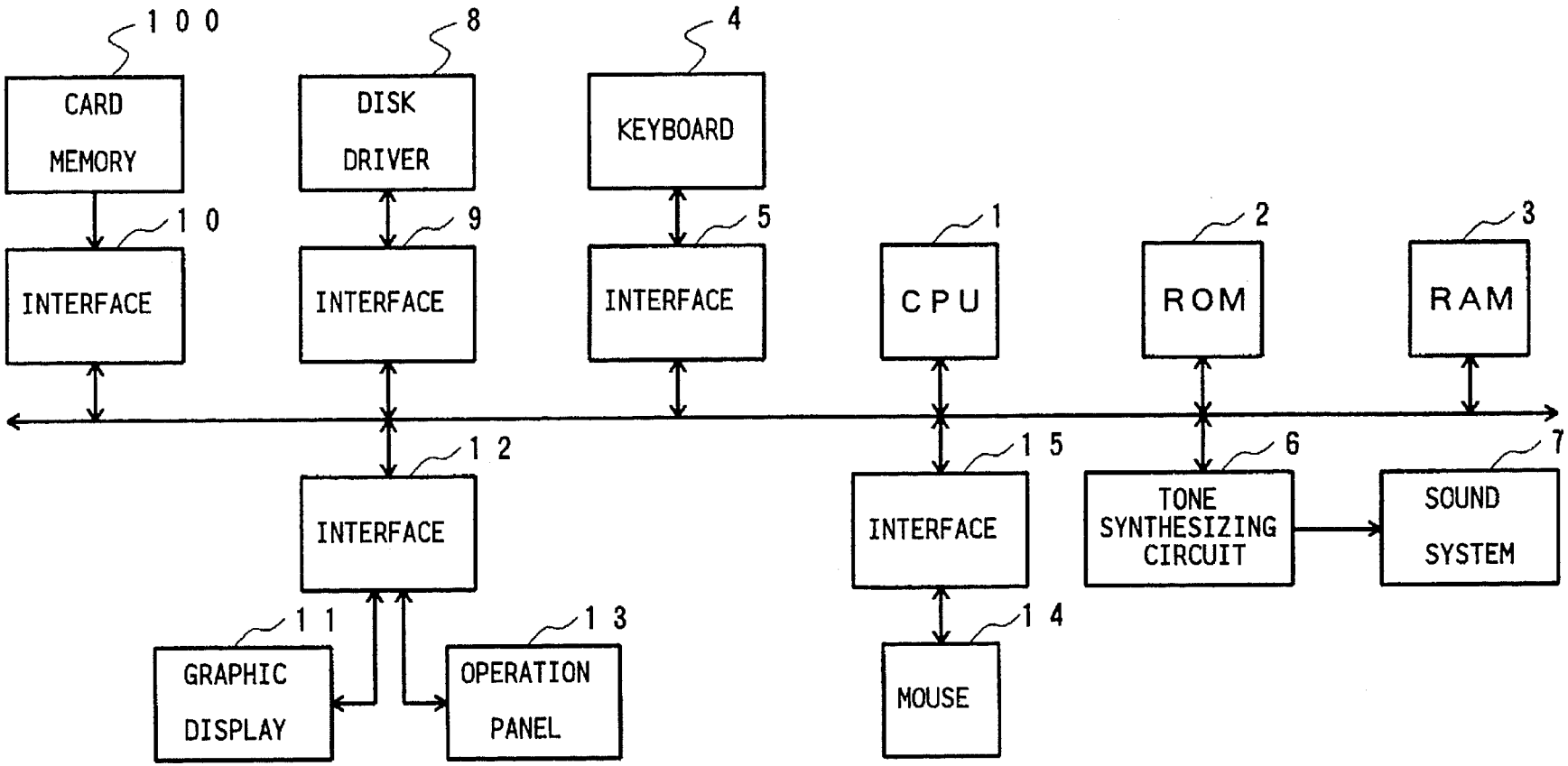
FIG. 1 is block diagram showing a hardware structure of en embodiment of an electronic musical instrument according to the invention.

FIG. 1 is a block diagram showing an embodiment of an electronic musical instrument made according to the invention. A central processing unit (hereinafter referred to as "CPU") 1 performs control of the entire electronic musical instrument by using a working area of a random-access memory (hereinafter referred to as "RAM") 3 and in accordance with a control program stored in a read-only memory (ROM) 2. When a keyboard 4 is played, the CPU 1 receives, in response to playing of keys, performance information including key-codes and key-on signal from the keyboard 4 through an interface 5, generates a tone signal having a predetermined tone color by a tone synthesizing circuit 6 on the basis of a currently set tone color, and generates a tone through a sound system 7. In the embodiment of electronic musical instrument, an individual tone which is distinguished from other tones on the basis of some features of the tone including its tone color and panning is called "voice" and each voice is given a voice name.

This electronic musical instrument has an editing function for setting and changing sound parameters a set of which is provided for each voice and also has a browser function including copying of data from a disk (a floppy disk) which is set in a disk driver 8, saving of data in the disk and copying of data from a card memory (e.g., RAM card) 100. Exchange of data with the disk driver 8 and the card 100 is made through a disk interface 9 and a card interface 10.

A graphic display 11 is made of a liquid crystal panel or the like and performs graphic display on the basis of display data input to a panel interface 12 by the control of the CPU 1 to display the state of the electronic musical instrument and operation states in the editing function and the browser function to be described later. An operation panel 13 includes ten keys and other switches for inputting numerical data of sound parameters and other data. The CPU 1 receives input data from the operation panel 13 through the panel interface 12 to perform processings in accordance with the input data.

A mouse 14 is an operator used in performing the editing function and the browser function. The mouse 14 has a click switch. Operation information of the mouse 14 is supplied to the CPU 1 through a mouse interface 15. The operation of depressing the click switch of the mouse 14 will hereinafter be sometimes called "click". The CPU 1 displays a pointer cursor on the graphic display 11 in accordance with the operation of the mouse 14 and performs various processings in accordance with the location of the pointer displayed on the display screen and the click operation of the mouse 14.

The tone synthesizing circuit 6 is a circuit which, responsive to the sound parameters set by the CPU 1, synthesizes a tone signal corresponding to each voice. The tone synthesizing circuit 6 includes an input circuit 61 inputting a key code KC and a key-on signal KON, a plurality of element tone generators 621–62*n* and a mixer circuit 63. The respective element tone generators 621–62*n* are circuits which independently generate tone signals. The element tone generator 621 for example is composed of a waveform generator 62*a*, a filter 52*b*, an envelope generator (hereinafter referred to as "EG") 62*c* and a panning circuit 62*d*.

In the element tone generator 621, the waveform generator 62*a* selects waveform data corresponding to a voice from an unillustrated waveform memory in response to sound parameter P1*a* corresponding to the voice and sequentially reads out this waveform data with a phase corresponding to the key code KC and supplies the read out data to the filter 62*b* as a waveform signal. The filter 62*b* imparts the tone signal with a tone color change in accordance with a filter characteristic set by sound parameter P1*b* and supplies the tone signal imparted with the tone color to the envelope generator 62*c* which, in turn, imparts the tone signal with an amplitude corresponding to the envelope shape set by sound parameter P1*c* and supplies the tone signal imparted with the amplitude to the panning circuit 62*d*. The panning circuit 62*d* performs distribution data to the left and right channesl in accordance with panning data set by sound parameter P1*d* and then supplies the tone signal to the mixer circuit 63.

In the element tone generators 621–62*n*, there are set parameter data P2*a*–P2*d*, . . . Pna–Pnd consisting of plural sound parameters corresponding to each circuit in the same manner as in the element tone generator 621 using the sound parameters P1*a*, P1*b*, P1*c* and P1*d*. The element tone generators 621–62*n* generate tone signals corresponding to the respective sound parameters and supply the tone signals to the mixer circuit 63. The mixer circuit 63 synthesizes the tone signals provided by the element tone generators 621–62*n* to form tone signals L and R of the left and right channels and supplies the tone signals L and R to the sound system 7. The number of the element tone generators used for tone generation is determined depending upon the kind of voice of the tone to be generated.

The RAM 3 has a parameter data memory area in which sound parameters are stored in correspondence to the respective voice names. Sound parameters copied from a disk or a card and sound parameters as preset data are stored in this parameter memory area. When sound parameters for a desired voice have been edited and saved, sound parameters for a voice which is the object of edition in the parameter memory area are rewritten by the sound parameters after the editing. A set of sound parameters corresponding to a currently selected voice is read from the parameter memory area and the respective sound parameters are supplied to a corresponding circuit in the tone synthesizing circuit 6 depending upon the type of the parameters to establish the tone color etc. in the tone synthesizing circuit 6.

Figure 7:
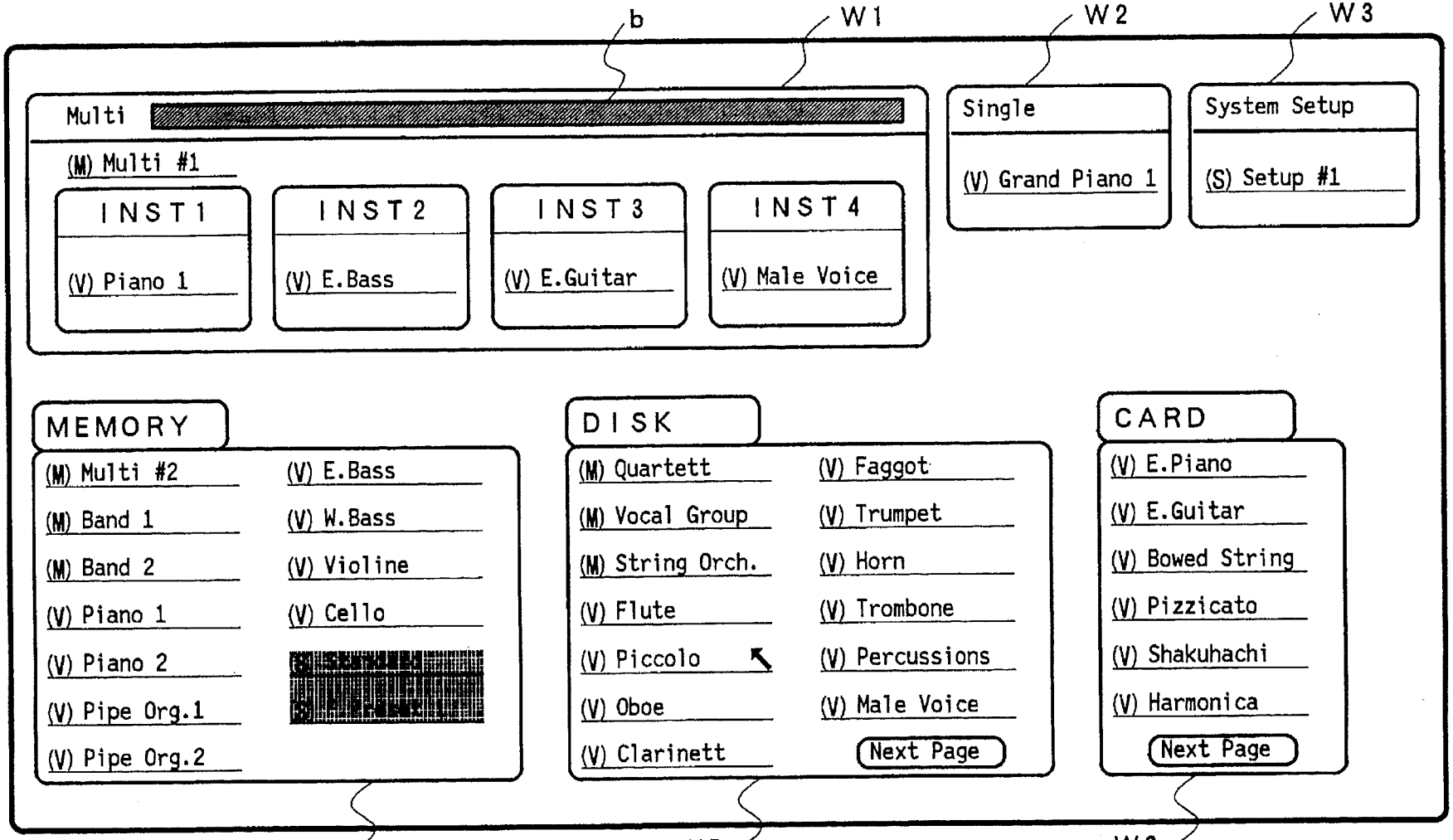
FIG. 7 is a diagram showing an example of display of a browser screen in the same embodiment.

An example of display and an example of operation in the graphic display 11 will now be described. In this embodiment, the graphic display is made in hierarchy structure. An initial display upon turning on of power, for example, is a display of the uppermost layer having six windows W1–W6 as shown in FIG. 7. The screen in which the windows W1–W6 are displayed is one used mainly for performing the data browser function and is called "browser screen".

The three windows W1, W2 and W3 of the upper stage are display for selecting an operation mode of the system. The window W1 is a display for indicating a multiple mode for sounding four different types of voices simultaneously by operating a sincle key. The window W2 is a display for indicating a single mode for sounding a single voice by operating a key on the keybaord 4. The window W3 is a display for indicating a system setup mode for setting up the system.

In the upper stage of the windows W1, W2 and W3 (hereinafter referred to as "title bar"), titles indicating the respective modes, i.e., "Multi", "Single" and "System Setup" are displayed. When a desired mode is to be selected, the mouse 14 is moved to set the pointer cursor to a desired title in one of the windows W1, W2 and W3 and then one click is made in the mouse 14. In response thereto, a bar display b is made in a space beside the title and a mode corresponding to the designated title is selected. In the example of FIG. 7, the multiple mode is selected.

In the window W1 for the multiple mode, the multiple name ("Multi #1 in the illustrated example) indicating the type of the multiple mode is displayed and also four blocks of "INST1"–"INST4" are displayed. In these blocks are displayed four types of voice names ("Piano 1", "E. Bass", "E. Guitar" and "Male Voice" in the illustrated example) each of which is set in correspondence to a currently set multiple names.

In the window W2 for the single mode, the voice name of the voice sounded in the single mode is displayed (in the illustrated example, "Grand Piano 1") and, in the window W3 for the system setup mode, a system setup data name (in the illustrated example, "System Setup") is displayed. At the heads of the multi name, voice name and setup data name are affixed symbols "M", "V" and "S" in parenthesis which are respectively first letters of "multi", "voice" and "setup".

The three lower stage windows W4, W5 and W6 display resources of voices and setup data which are available for use in this electronic musical instrument. At the left top of the windows W4, W5 and W6 are displayed "MEMORY", "DISK" and "CARD" representing respectively the memory (RAM 3), disk and card and the names of data stored in the RAM 3, disk and card are respectively displayed in the windows W4, W5 and W6. When the disk or the card is replaced by a different one, the contents of display are replaced accordingly. The indication of "Next Page" in the windows W5 for the disk and W6 for the card represent that there is data which is left undisplayed in these windows. By moving the mouse 14 to set the pointer cursor to "Next Page" and then making a click on the mouse 14, the remaining data is displayed.

The display of the multiple name, voice name and setup data name in the windows W4, W5 and W6 is utilized for selectively designating each data by the operation of the mouse consisting of setting of the pointer cursor and subsequent clicking. In the multiple mode, the multiple name and the voice name only can be designated whereas, in the single mode, the voice name only can be designated. In each mode, a name which can be designated is displayed in a normal manner and a name which cannot be designated is displayed in half tone or in coarse dotted letters. In FIG. 7, for example, the multiple mode is selected and, therefore, the setup data names are displayed in half tone (or in coarse dotted letters) indicating that these names cannot be designated.

When the editing function of sound parameters is executed, a voice name which is the object of edition in the windows W1 and W2 is selectively designated in the multiple mode or single mode of the browser screen by making two clicks in the mouse 14. Further, when data is to be copied in the data browser function, the data name of data to be copied is selectively designated by a single clicking motion by the mouse 14.

Figure 8:
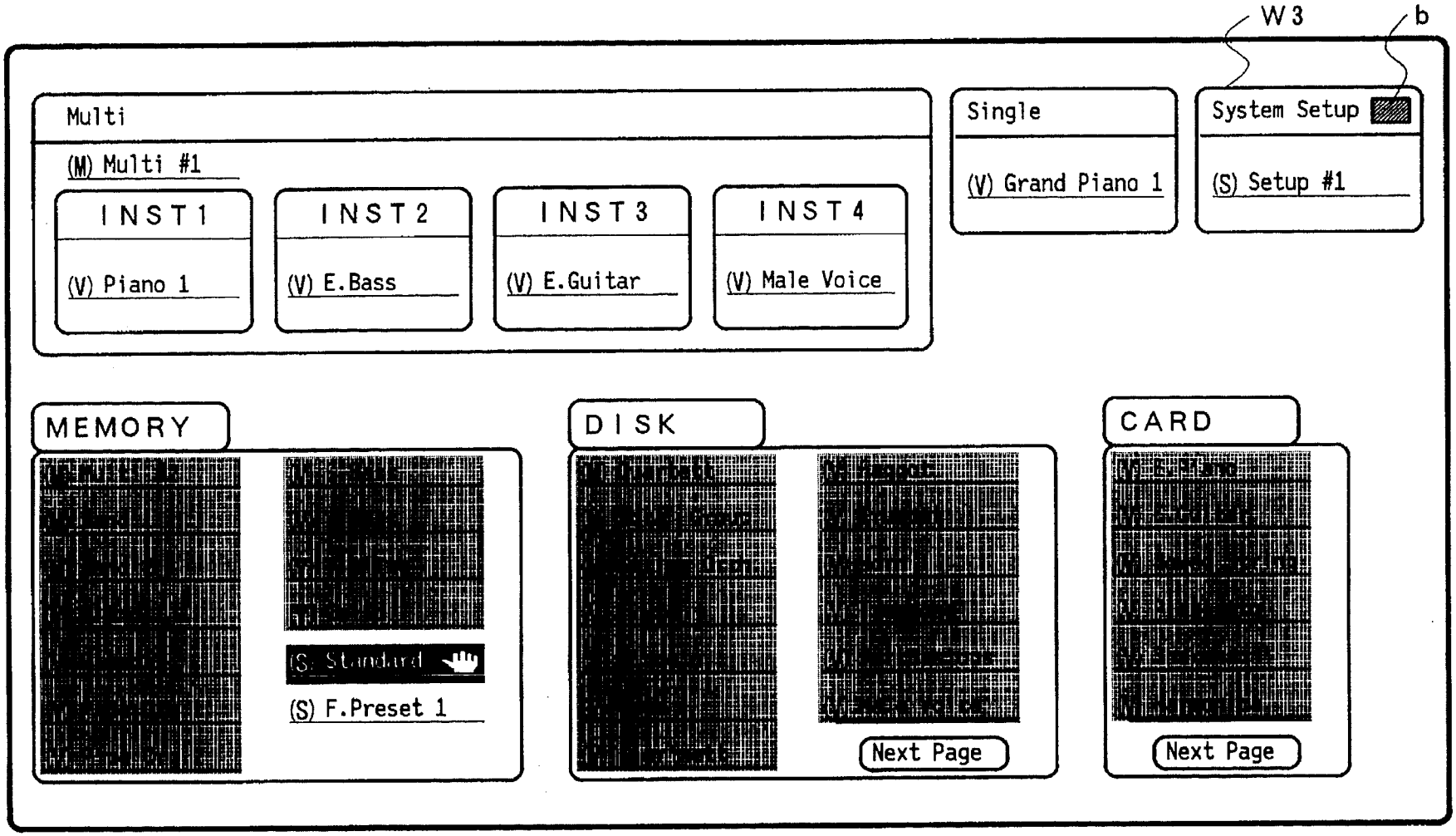
FIG. 8 is a diagram showing an example of display during data selection in the browser screen in the same embodiment.

The data browser function will now be described. FIG. 8 shows an example of operation of the browser function and FIG. 9 an example of display thereof. As shown by bar display b in the window W3, this is a case where setup data is to be set in the system setup mode. Since data which can be designated in the system setup mode is setup data only, the multiple name and voice name in the windows W4, W5 and W6 are all displayed in half tone or coarse dotted letters, indicating that these data cannot be designated.

The pointer cursor is moved to a desired setup data name and the click switch is turned on in the mouse 14. The pointer cursor thereupon is changed to the shape of a hand as shown in FIG. 8 and the designated name ("Standard" in the illustrated example) is displayed in an inverted manner. By moving the mouse 14 (i.e., dragging) while the click switch is kept depressed, the display of the hand-shaped cursor and the inverted name is moved.

As the display of the hand-shaped pointer cursor and the inverted name display are moved to the window W3 for the system setup mode, the window W3 becomes an inverted display indicating that copying of data to this window W3 is possible. By releasing the click switch in the mouse 14, the moved name is displayed in the window W3 and the setup data is transferred from the memory. In this case, when the source of copied data is a disk or a card, data is transferred to the internal RAM 3 at this time point.

Since a region which can accept setup data is the window W3 for the setup mode and the windows W4, W5 and W6 for the respective resources, when the hand-shaped pointer cursor arrives at these windows while setup data is being dragged, the display in the windows W3, W4, W5 and W6 becomes inverted but the display in the window W1 for the multiple mode and the display on the window W2 for the single mode are not inverted, indicating that these windows cannot accept the setup data.

The data browser function has been described above by taking a case where the system setup data is copied for example. In a case where data in a disk and a card is to be copied in the memory or where data is to be copied from the memory to a disk or a card or where data is to be copied between a disk and a card, copying of data can be realized by setting the multiple mode or the single mode and operating the mouse in a manner similar to the above described case to copy the name of each data between the windows. In this case also, in a region which can accept data, display in this window is inverted when the pointer cursor comes on the window.

Figure 10:
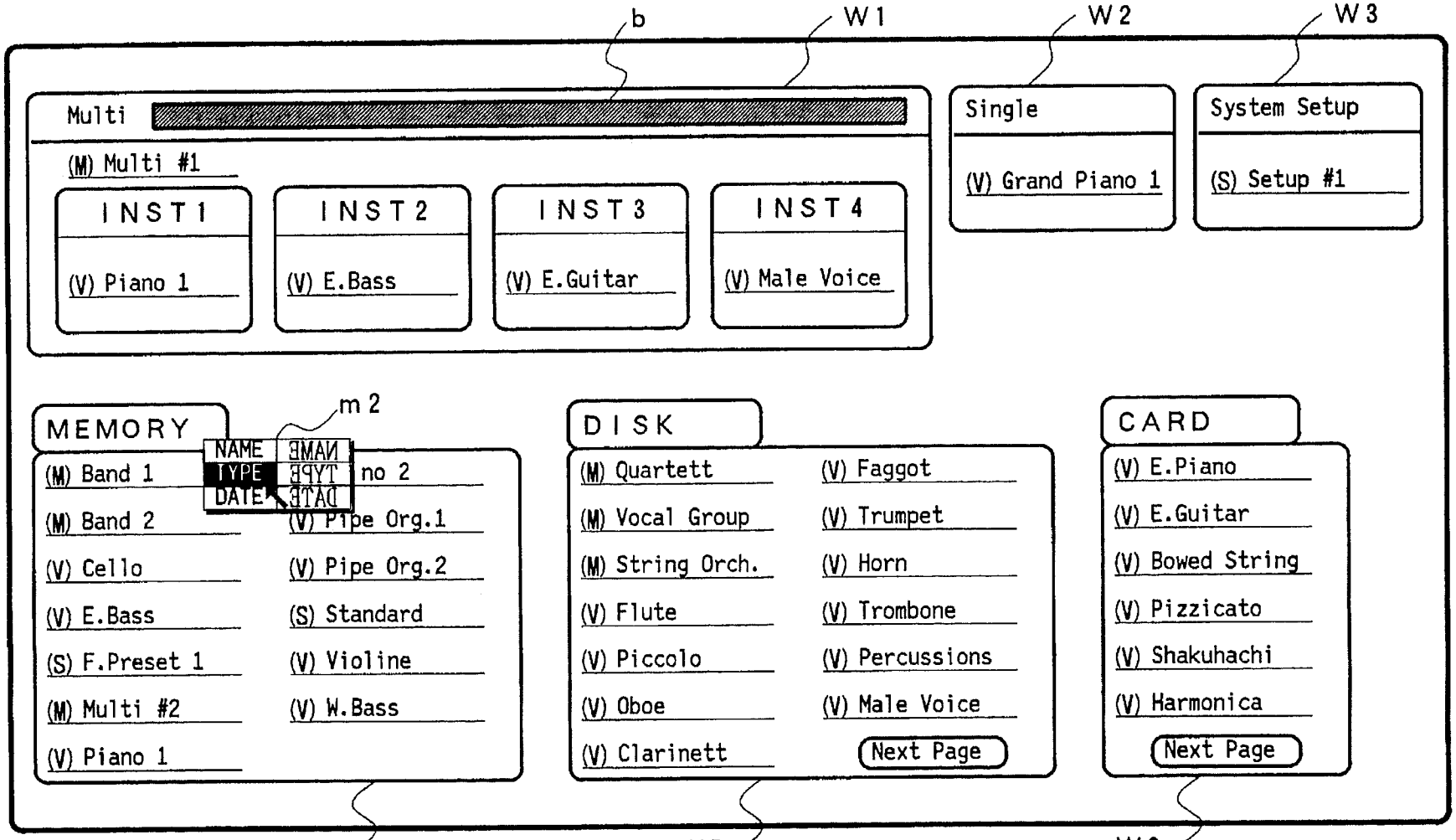
FIG. 10 is a diagram showing an example of display of a pop-up menu in the browser screen in the same embodiment.

In this embodiment, data can be rearranged in the respective windows W4, W5 and W6 of the memory, disk and card. As shown in FIG. 10, for example, when the click switch is depressed and released on a device name ("MEMORY" in this example), a pop-up menu m2 is displayed. By clicking at a desired item name ("NAME", "TYPE", "DATE" etc.) in the pop-up menu m2 a rule of rearrangement is designated.

In the example of FIG. 10, the item name of "TYPE" is displayed invertedly indicating that data arranged currently in the order of the name (i.e., alphabetic order) should be rearranged in the order of the data type. "NAME" designates that data should be rearranged in the order of the name and "DATE" designates that data should be rearranged in the order of the date of editing of data. The mirror-inverted characters of "NAME", "TYPE" and "DATE" designate that data should be rearranged in reverse orders of the orders of the name, type and date.

An example of the sound parameter editing function will now be described.

When a voice to be edited is selected, a desired voice name in the windows W1 and W2 is designated by the pointer cursor in the browser screen of the multiple mode or the single mode (e.g., the screen of FIG. 7) and then click is made twice in the mouse 14. The screen thereby becomes an edition screen as shown in FIG. 3 in which the voice name ("Piano 1" in the illustrated example) and the structure corresponding to this voice name are schematically shown.

Figure 2:
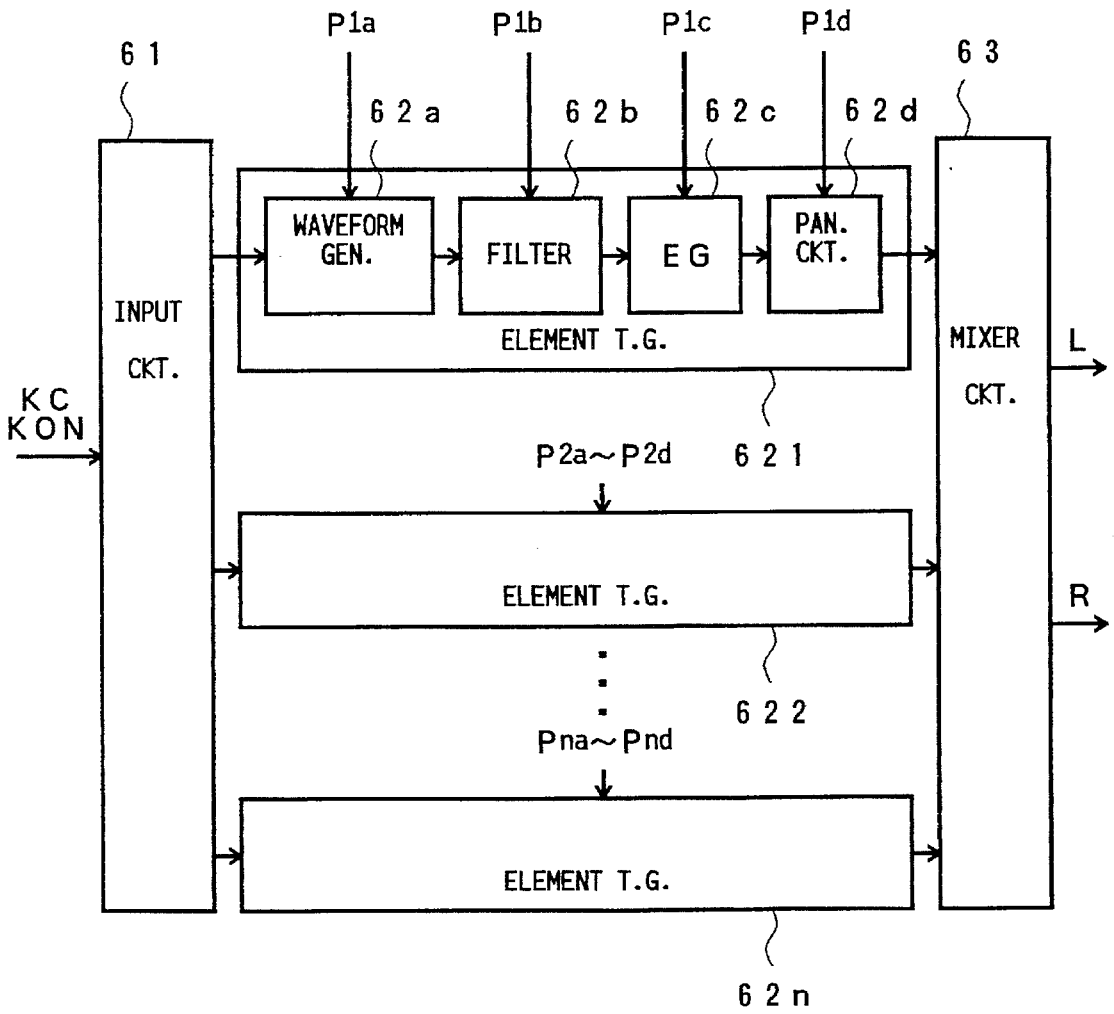
FIG. 2 is a block diagram showing an example of a tone synthesizing circuit in the same embodiment.
Figure 3:
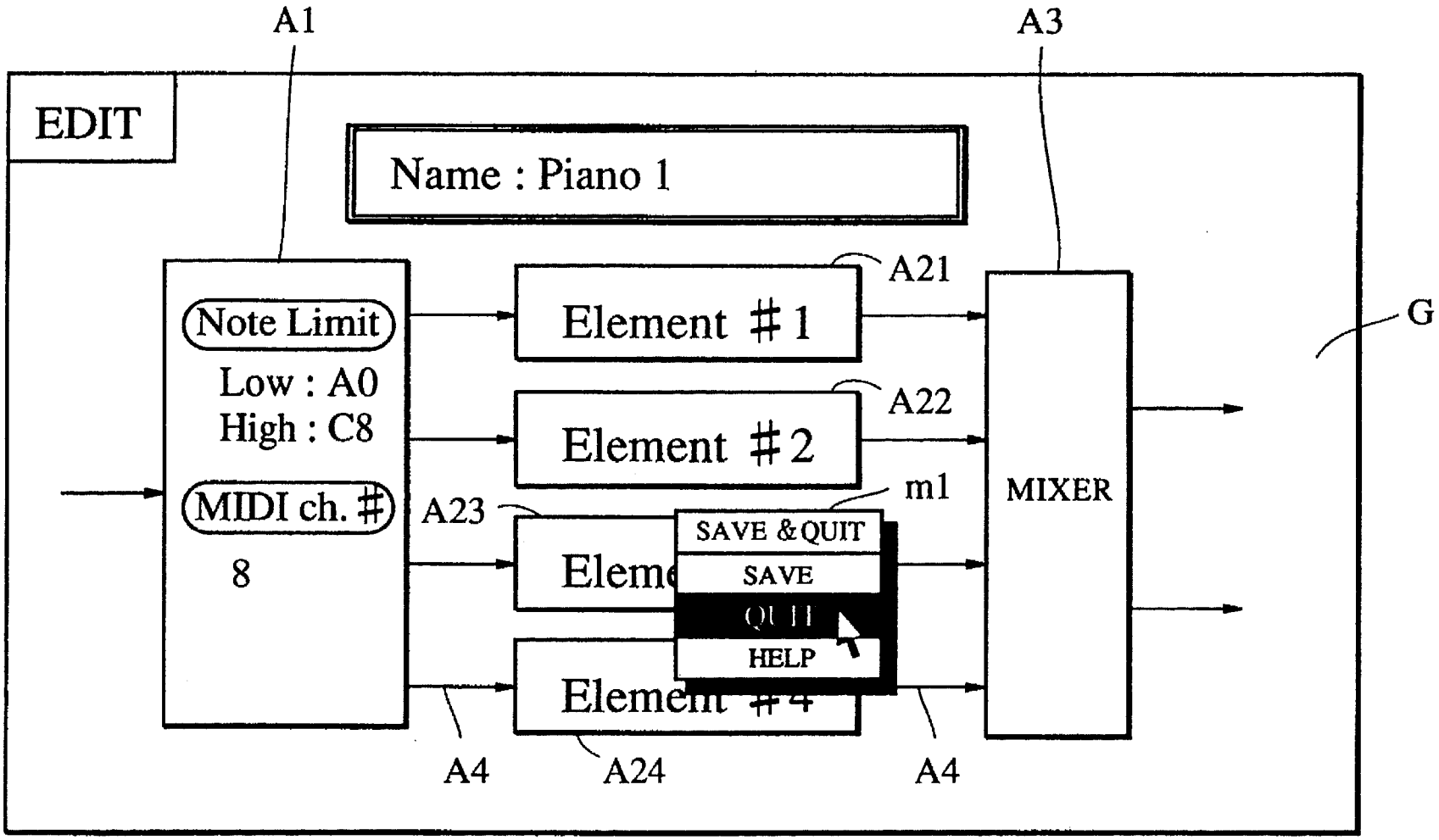
FIG. 3 is a diagram showing an example of display of an editing screen in the same embodiment.

More specifically, in the screen shown in FIG. 3, a function block A1 corresponding to the input circuit 61 of the tone synthesizing circuit 6, function blocks A21–A24 corresponding to the element tone generators 621–624 and a block function A3 corresponding to the mixer circuit 63 are displayed. In this display, the function blocks A1, A21–A24 and A3 are connected with a connection pattern A4 thereby showing the structure of the tone synthesizing circuit 6 as shown in FIG. 2. In the example of FIG. 3, the voice is synthesized by using four element tone generators, namely four elements #1–#4, in the tone synthesizing circuit 6. It should be noted, however, that the function blocks A21, A22, . . . are displayed by the number of the element tone generators **621–62*n*** used in the selected voice.

Figure 4:
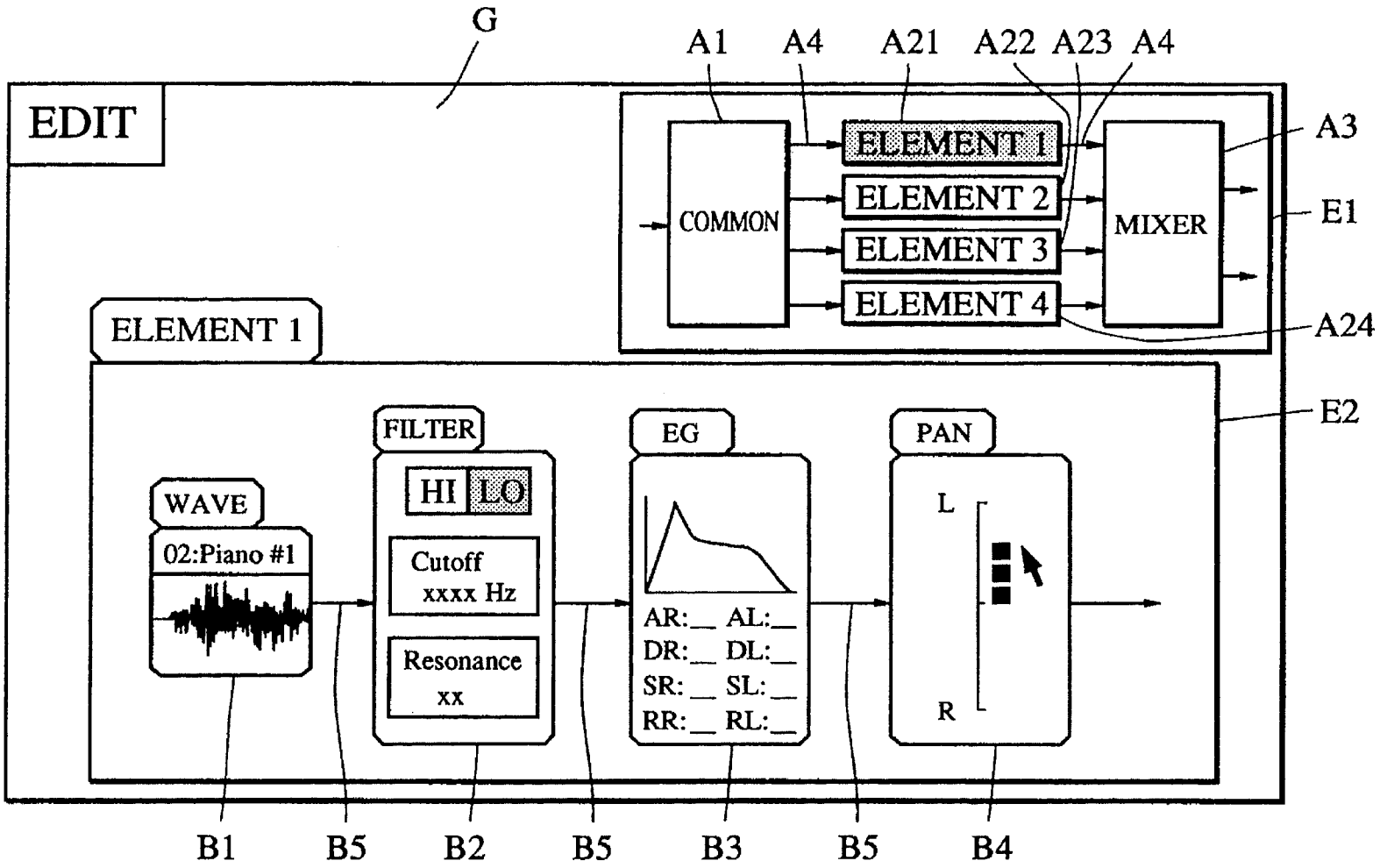
FIG. 4 is a diagram showing an example of display of the editing screen in the same embodiment when an element tone generator has been selected.

When a desired function block has been designated by the pointer cursor and the click switch is turned on, the screen becomes an editing screen as shown in FIG. 4 in which sound parameters available for use in the designated function block can be edited. FIG. 4 shows an editing screen in which a function block A21 for the element #1 has been selected by clicking. In this editing screen, two windows E1 and E2 are displayed. In the window E1, the structure including the function blocks A1, A21–A24 and A3 and the connection pattern A4 similar to that shown in FIG. 3 is schematically illustrated and the function block which is currently the object of edition is displayed in the emphasized form. Since the element tone generator No. 1 is selected in this example, the function block A21 indicating the element #1 in the window E1 is emphasized by displaying it in half tone. By this emphasized display, the relation between the element #1 which is to be currently edited and the remaining portion of the tone source can be recognized by glancing at the screen.

In the other window E2, a function block B1 indicating the waveform generator **62*a*, a function block B2 indicating the filter 62*b*, a function block B3 indicating the envelope generator 62*c* and a function block B4 indicating the panning circuit 62*d* of the element tone generator 621 corresponding to the element #1 are displayed. The respective function blocks B1–B4 are connected by a connection pattern B5 to display the circuit structure of the element tone generator 621 as shown in FIG. 2. In the respective function blocks B1–B4, the types and contents of sound parameters set in the waveform generator 62***a*, filter 62*b*, envelope generator 62*c* and panning circuit 62*d* are displayed. At the left top of the respective function blocks B1–B4 are displayed circuit names ("WAVE", "FILTER", "EG" and "PAN") indicating the waveform generator 62*a*, filter 62*b*, envelope generator 62*c* and panning circuit 62*d*.

When a function block in which sound parameters should be edited is selected from among the function blokes B1–B4 in the editing screen, the pointer cursor is set at the desired function block and the click switch of the mouse 14 is turned on. When, for example, the function block B3 for the EG has been selected, the screen becomes the editing screen of FIG. 5 in which sound parameters in the envelope generator 62*c* can be edited. In this editing screen also, in the same manner as in FIG. 4, the structure including the function blocks A1, A21–A24 and A3 and the connection pattern A4 is schematically illustrated in the window E1 and the function block indicating the element #1 which is currently the object of editing is emphatically displayed.

In another window E3, the type of sound parameter set in the envelope generator 62*c* and sound parameters which are currently set are displayed and graphic display of an envelope shape corresponding to the respective parameters is made. When the sound parameters are renewed, the graphic display representing the envelope shape is also renewed.

In addition to the sound parameters described above, a window E2' which is the wondow E2 of FIG. 4 in a reduced scale is also displayed in the window E3. In the window E2', there is schematically shown the structure of the element tone generator 621 corresponding to the element #1 similar to that shown in FIG. 4 having the function blocks B1, B2, B3 and B4 and the connection pattern B5 and the function block of the envelope generator 62*c* is emphatically displayed by the inverted display. By this arrangment, the relation between the envelope generator 62*c* and the other circuits in the element tone generator 621 corresponding to the element #1 can be recognized readily by glancing at the screen.

When the pointer cursor is set at a background G in each editing screen and the click switch of the mouse 14 is turned on, the pop-up menu m1 as shown in FIG. 3 is displayed. This pop-up menu m1 is used in a case where edited contents are saved upon completion of the editing of sound parameters, where the cursor is to return to a screen of a higher layer or where the manner of operation is to be confirmed. By moving the pointer cursor to a desired one of item names ("SAVE & QUIT", "SAVE", "QUIT" and "HELP") and turning on the click switch, a desired processing can be selected from among a processing for saving sound parameters and returning to a screen of a higher layer ("SAVE & QUIT"), a processing for saving sound parameters ("SAVE"). a processing for returning to a screen of a higher layer ("QUIT") and a help function for confirming the manner of operation ("HELP").

Figure 5:
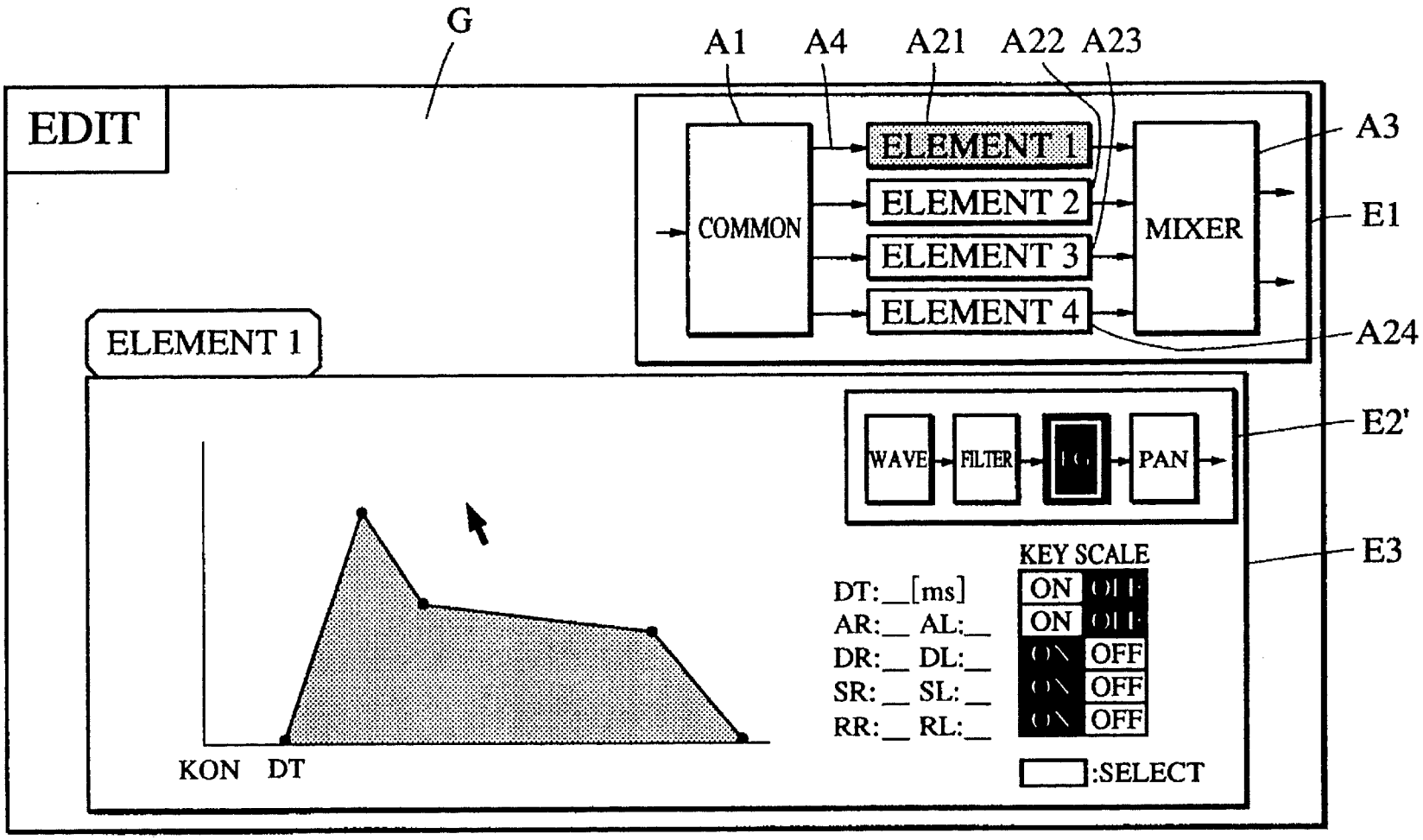
FIG. 5 is a diagram showing an example of display of the edition screen in the same embodiment when an envelope generator has been selected.

In the above described example, description has been made about the case where the editing screen is changed toward one of a lower layer in the hierarchy strucuture in the order of FIGS. 3, 4 and 5. Alternatively, by designating a desired other function block in the window E1 or E2' in the editing screen of FIG. 4 or FIG. 5 by moving the pointer cursor and turning on the click switch, the screen can be shifted directly to the editing screen of the desired function block without passing through the editing screen of a higher layer such as that of FIG. 3. For example, by turning on the click switch at the function block of MIXER in the window E1 in the editing screen of FIG. 4 or FIG. 5, the screen is changed to the editing screen for the mixer circuit 62*d* as shown in FIG. 6 so that edition of sound parameters for the mixer circuit 62*d* can be made in this editing screen.

Figure 6:
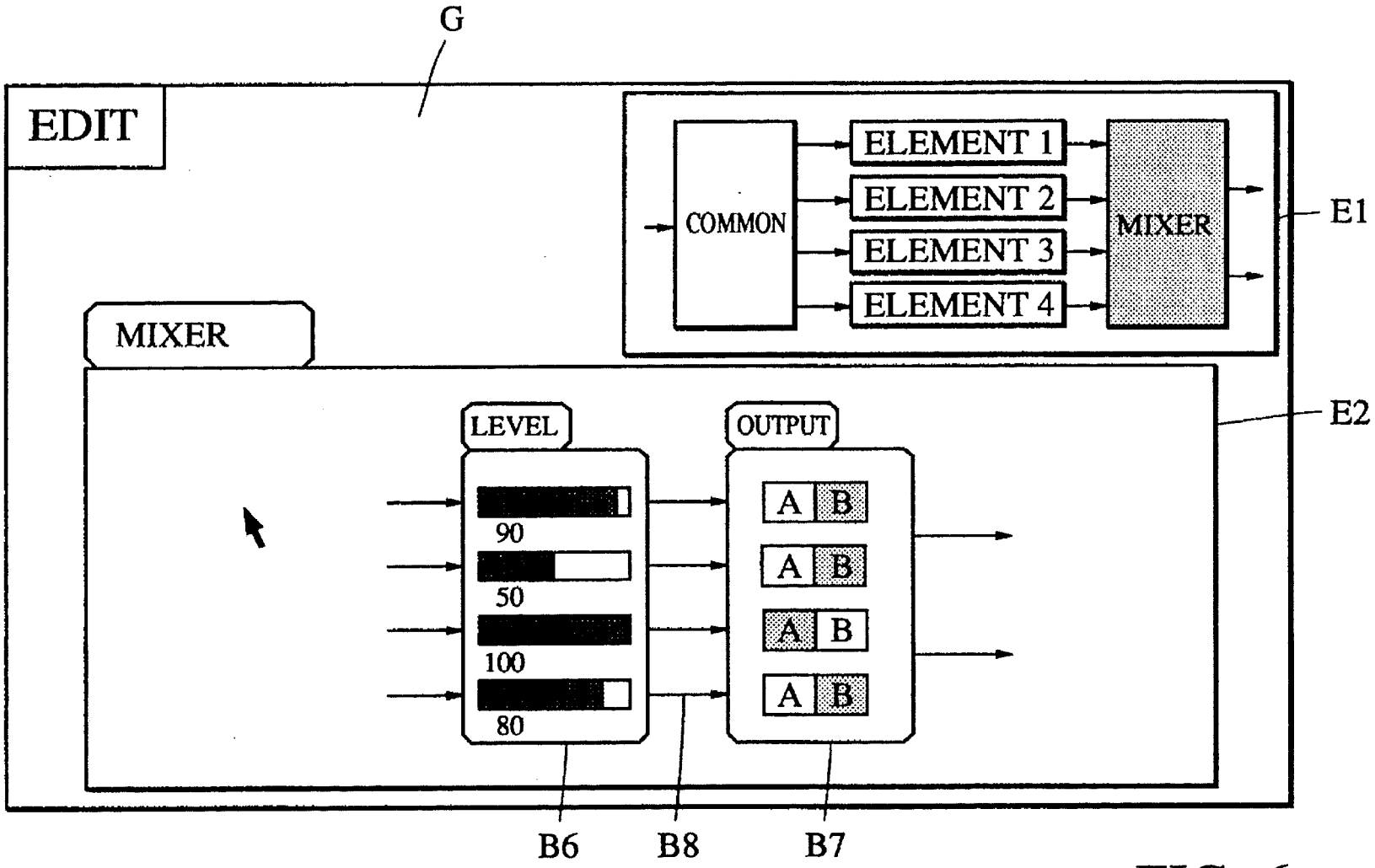
FIG. 6 is a diagram showing an example of display of the editing screen in the same embodiment when a mixer circuit has been selected.

In the editing screen of FIG. 6 also, the structure similar to the one shown in FIG. 3 including the function blocks A1, A21–A24 and A3 and the connection pattern A4 is schematically shown in the window E1. In this case, the MIXER function block indicating the mixer circuit 62*d* is displayed in half tone so that the relation between the mixer circuit 62*d* and the other circuit of the mixer circuit 62*d* can be recognized readily by glancing at the screen. In the other window E2, the structure showing the mixer circuit 62*d* is schematically displayed by function blocks B6 and B7 and connection pattern B8.

Figure 11:
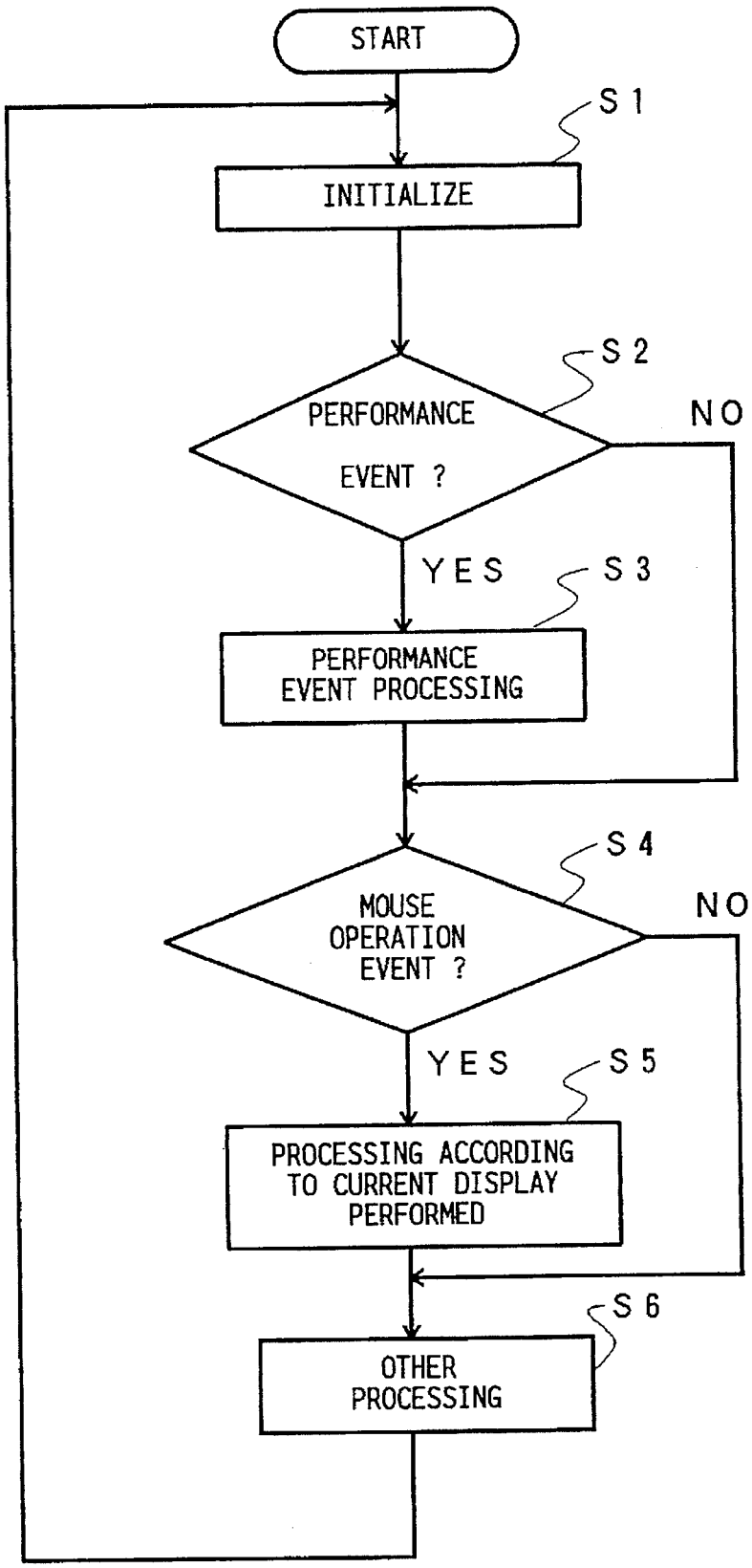
FIG. 11 is a flow chart showing the main routine in the same embodiment.

An essential portion of controls made in the electronic musical instrument of this embodiment will now be described. First, upon turning on of power, the CPU 1 starts processing of the main routine of FIG. 11. In step S1, initializing including display of the browser screen as an initial screen and presetting of various data is performed. Then, in step S2, presence or absence of a performance event, e.g., depression of a key or release of a key, is detected. When there is no performance event, the routine proceeds to step S4. When there is a performance event, a performance event processing such as sounding of a tone or cease of sounding of a tone is performed in step S3 and then the routine proceeds to step S4.

In step S4, presence or absence of an operation event in the mouse 14 is detected. When there is no operation event, the routine proceeds to step S6, whereas when there is an operation event, the editing screen processing of FIG. 12 or the browser screen processing of FIG. 13 is performed in step S5 in accordance with the currently displayed graphic display 11 and then the routine proceeds to step S6. In step S6, other processing, e.g., monitoring the disk interface 9 and the card interface 10 and, when the disk or card has been replaced, displaying the data name of data stored in the newly mounted disk or card is performed. Then, the routine returns to step S2 and the processings from step S2 to step S6 are repeatedly performed.

When it has been detected that the browser screen is displayed in step S5, a browser screen processing of FIG. 13 is performed. In FIG. 13, whether or not the current position of the pointer is within the resource region (i.e., windows W4, W5 and W6) is detected in step S31. When the pointer is not within the resource region, a system event processing (FIG. 15) is performed in step S32 and then the routine proceeds to step S39. When the pointer is within the resource region, whether or not there is a mouse ON event (i.e., the click switch is on) is detected in step S33. When there is the mouse ON event, the processing of step S35 and subsequent processings are performed. When there is no mouse ON event, a drag release processing (FIG. 14) is performed in step S34 and then the routine proceeds to step S39.

In step S35, whether or not the pointer cursor is on the data name, i.e., whether or not the click operation has been made on the data name, is detected. When the pointer cursor is not on the data name, other processings such as the pop-up menu and "Next Page" are performed in step S36 and then the routine proceeds to step S39. When the pointer cursor is on the data name, it is judged that desired source data has been selected and, in step S37, the shape of the pointer cursor is changed from the shape of arrow to the shape of the hand and the data name is invertedly displayed and the data name selected by a source register SRG (i.e., the invertedly displayed data name) is stored. Then, a flag DRAG is set to "1" in step S38 to bring about a dragging start state and the routine proceeds to step S39. The flag DRAG is a flag which stores the data dragging state as "1" and the other state as "0".

In step S39, whether or not the current mouse event is a drag event, i.e., whether or not the mouse is being moved with the click switch having been turned on, is detected. When the mouse event is not the drag event, the routine proceeds to step S302. When the mouse event is the drag event, a dragging processing is performed in step S301 and other processings are performed in step S302 and then the routine returns to the main routine. In the dragging processing of step S301, processings including a processing for moving the hand-shaped pointer cursor and the invertedly displayed data name on the screen and a processing for invertedly displaying a window when the pointer cursor has passed a region where data can be copied in the window are performed.

Figure 14:
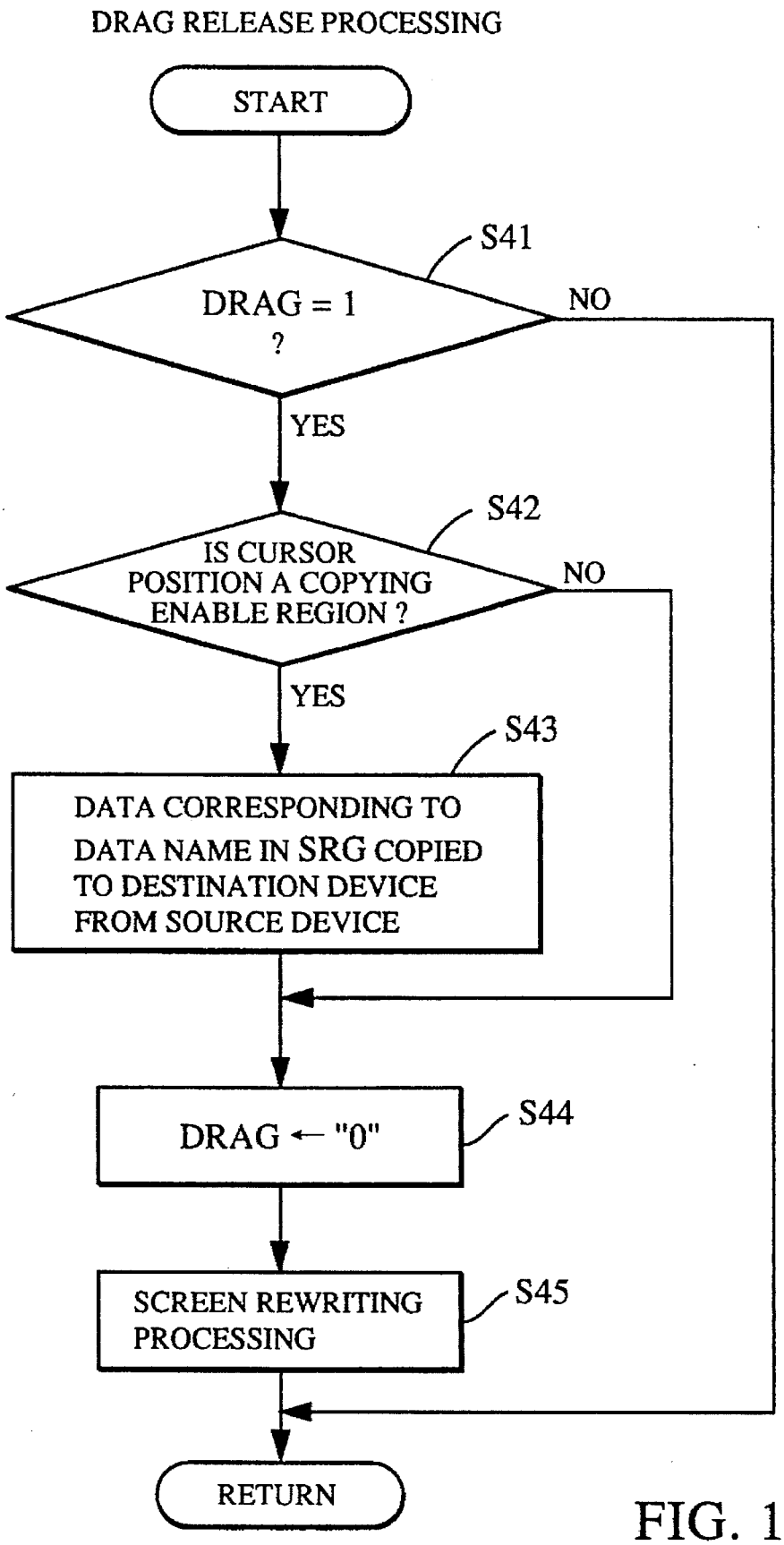
FIG. 14 is a flow chart showing a drag release processing in the same embodiment.

The drag release processing shown in FIG. 14 is a processing which is performed when the click switch has been turned off (OFF event). First, in step S41, whether DRAG=1 or not, i.e., whether or not the data is being dragged, is detected. When the data is not being dragged (DRAG=0), the routine returns to the former routine. When the data is being dragged (DRAG=1), whether or not the pointer cursor position is within the copying enable region is detected. When the pointer cursor is not within the copying enable region, the routine proceeds to step S44 in which the flag DRAG is reset to "0". Then, in step S45, a processing for rewriting the screen such as returning the shape of the pointer cursor to the original shape is performed and then the routine returns to the former routine. When the pointer cursor is within the copying enable region, it means the click switch releasing operation has designated destination data and the routine proceeds to step S43 in which data is read from the device (RAM 3, card or disk) storing data corresponding to the data name which has been dragged (this data name is stored in the source register SRG) and this data is copied to the device at which the pointer cursor is located when the click switch has been released. Then, processings of steps S44 and S45 are performed and the routine returns to the former routine.

Figure 15:
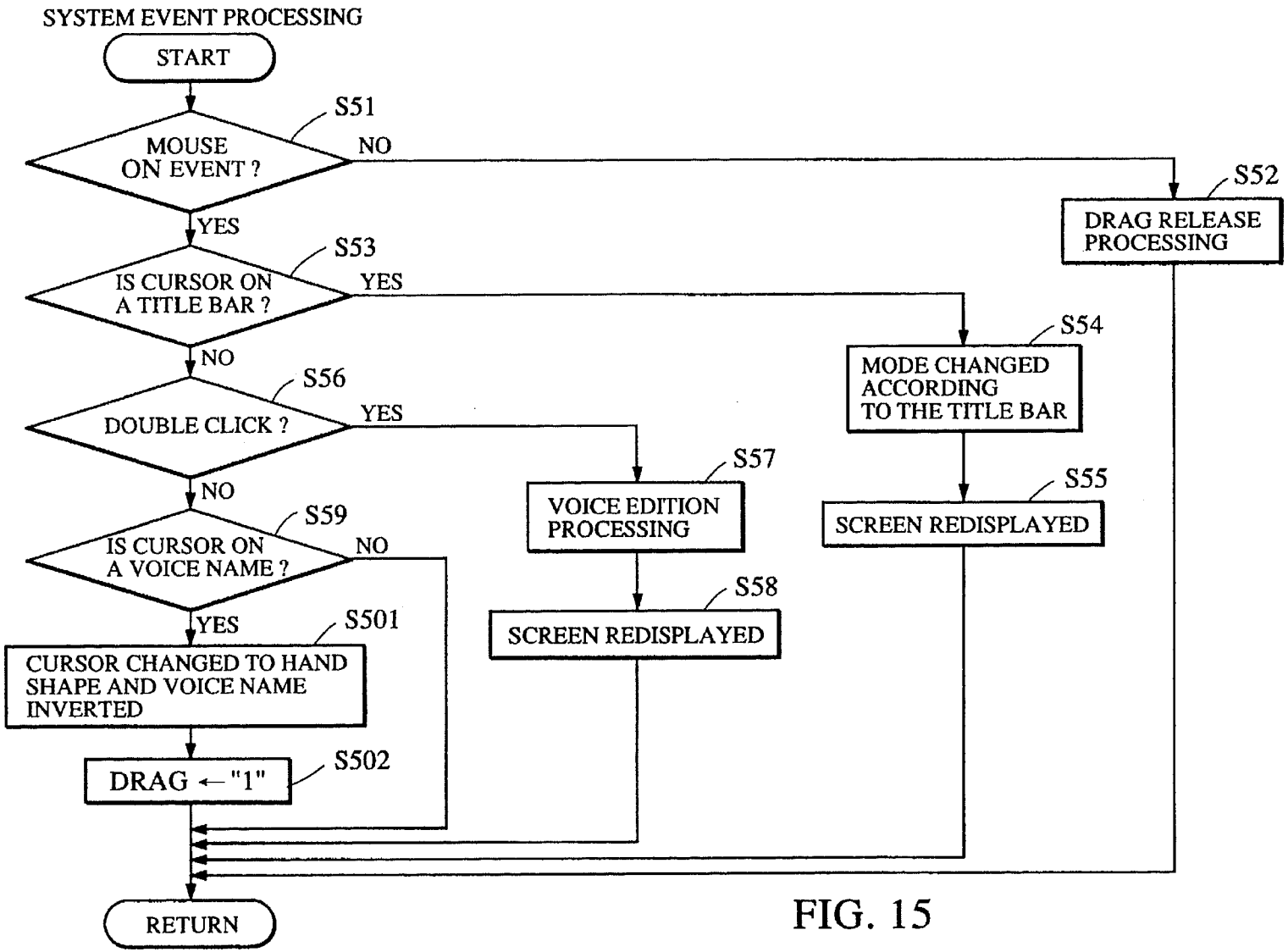
FIG. 15 is a flow chart showing a system event processing in the same embodiment.

The system event processing shown in FIG. 15 is a processing performed when the mouse event has occurred in a region other than the resource region in the browser screen. First, in step S51, whether or not there is a mouse ON event is detected. When there is the mouse ON event, a processing of step S53 and subsequent processings are performed. When there is no mouse ON evnet, the drag release processing of FIG. 14 is performed in step S52 and then the routine returns to the browser screen processing.

In step S53, whether or not the pointer cursor is on the title bar (region in which the title is displayed) of the window W1, W2 or W3 is detected. When the pointer cursor is on the title bar, the mode is changed in accordance with the window of the title bar, i.e., the region in which the click has been made, in step S54 and, in step S55, the screen according to the changed mode is redisplayed. Then, the routine returns to the browser screen processing.

When the click switch is not operated on the title bar, whether or not there is a double click of a voice name in step S56. When there is a double click of a voice name, a voice edition processing is set in step S57 and then, in step S58, a corresponding screen is redisplayed and the routine returns to the browser screen processing. The edition screen remains unchanged even after the routine returns to the browser screen processing of FIG. 13 and, when there is a mouse event in the main routine, the routine proceeds to the edition screen processing in step S5.

When there is no double click of a voice name in step S56, whether or not the click has been made on a voice name is detected in step S59. When the click has not been made on a voice click, the routine returns to the browser screen processing. When the click has been made on a voice name, the shape of the pointer cursor is changed to the hand shape and its data name (voice name) is invertedly displayed in step S501. Then, in step S502, the flag DRAG is set to "1" and the routine returns to the browser screen processing.

Figure 12:
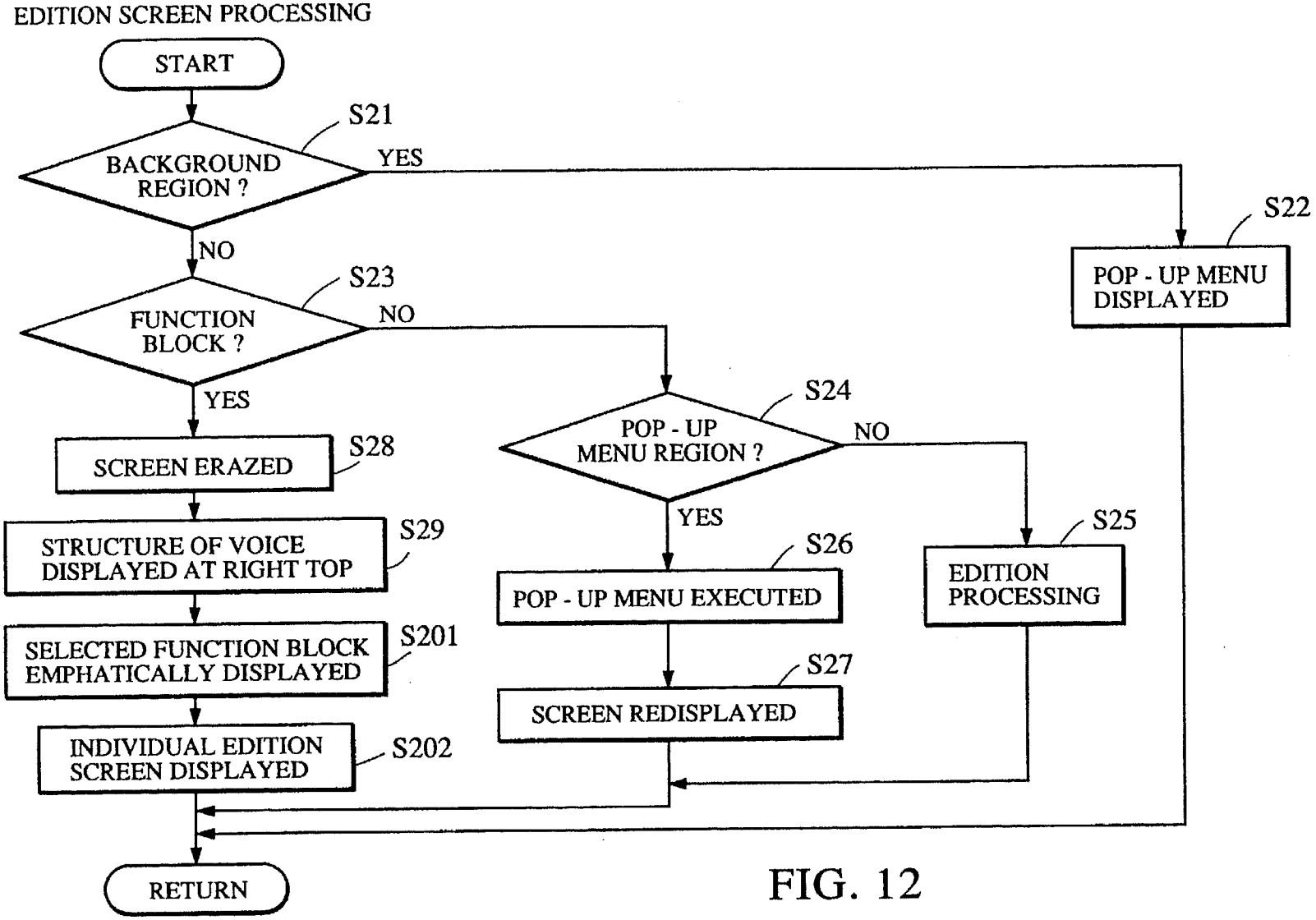
FIG. 12 is a flow chart showing an editing screen processing in the same embodiment.
Figure 13:
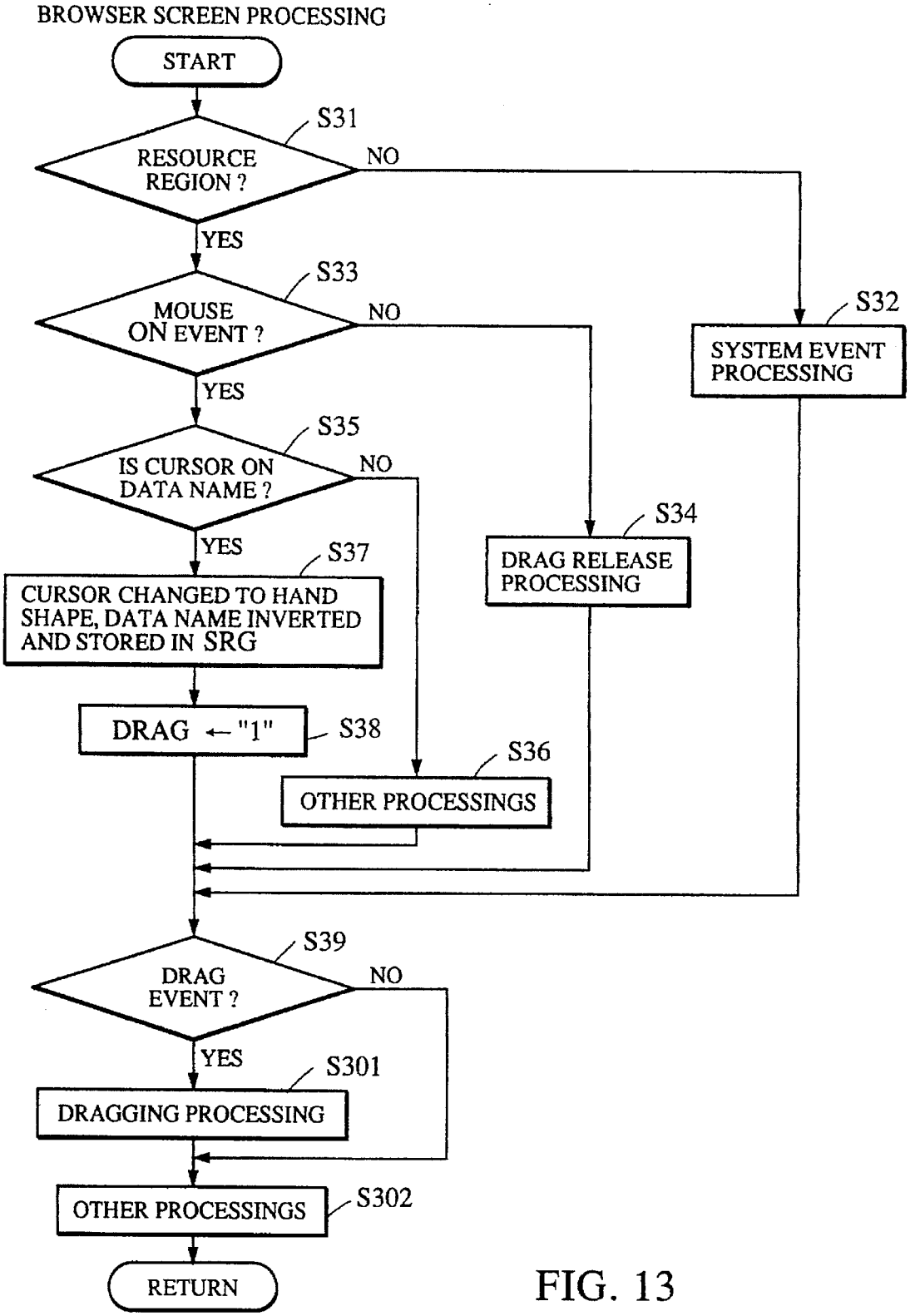
FIG. 13 is a flow chart showing a browser screen processing in the same embodiment.

Then, in the editing screen processing shown in FIG. 12, in step S21, whether or not the current pointer cursor position is within the background region G is detected. When the pointer cursor is within the backround region G, a pop-up menu (FIG. 3) is displayed in step S22 and the routine returns to the main routine. When the pointer cursor is not within the background region G, whether or not the current pointer cursor position is on a function block is detected in step S23. When the pointer cursor is on a function block, a processing of step S28 and subsequent processings are performed. When the pointer cursor is not on a function block, whether or not it is a region of the pop-up menu is detected.

When it is not the pop-up menu region, the edition processing is performed in step S25 and then the routine returns to the main routine. When it is the pop-up menu region, a processing of a corresponding item of the pop-up menu is executed in step S26 and then the screen is redisplayed in step S27 and thereafter the routine returns to the main routine.

When it has been detected that the pointer cursor is on a function block in step S23, the screen is once erased in step S 28. The structure of the voice is schematically shown at the right top of the screen in step S29 and the region corresponding to the currently selected function block is emphatically displayed in step S201. Then, in step S202, display of individual editing screens including the internal structure of the currently selected function block such as those shown in FIGS. 4 and 6 and display of sound parameters is made and then the routine returns to the main routine.

Summing up the above described processings, some display is made on the graphic display 11 by the initializing processing of step S1 and the processing of step S55 or S58 and the individual editing screen processings of FIG. 12 or the browser screen processing of FIG. 13 is performed by the mouse event in accordance with the screen displayed in step S5.

In the editing screen processing, other editing screen is displayed by the processings of steps S29 and S202 and the processings of the editing screen processing of FIG. 12 are performed with respect to the other editing screen. In each editing screen, the structure of the sound source is always schematically illustrated so that the relation with the portion which is the object of editing can be recognized easily and the editing work can thereby be facilitated.

It will be understood that, in the above described embodiment, the schematic display on the function block in the graphic display 11 performs not only the function of schematically showing the structure of the sound source system but also a function of input selection means such, for example, as enabling shifting to another editing screen by selection by the pointer cursor.

Figure 9:
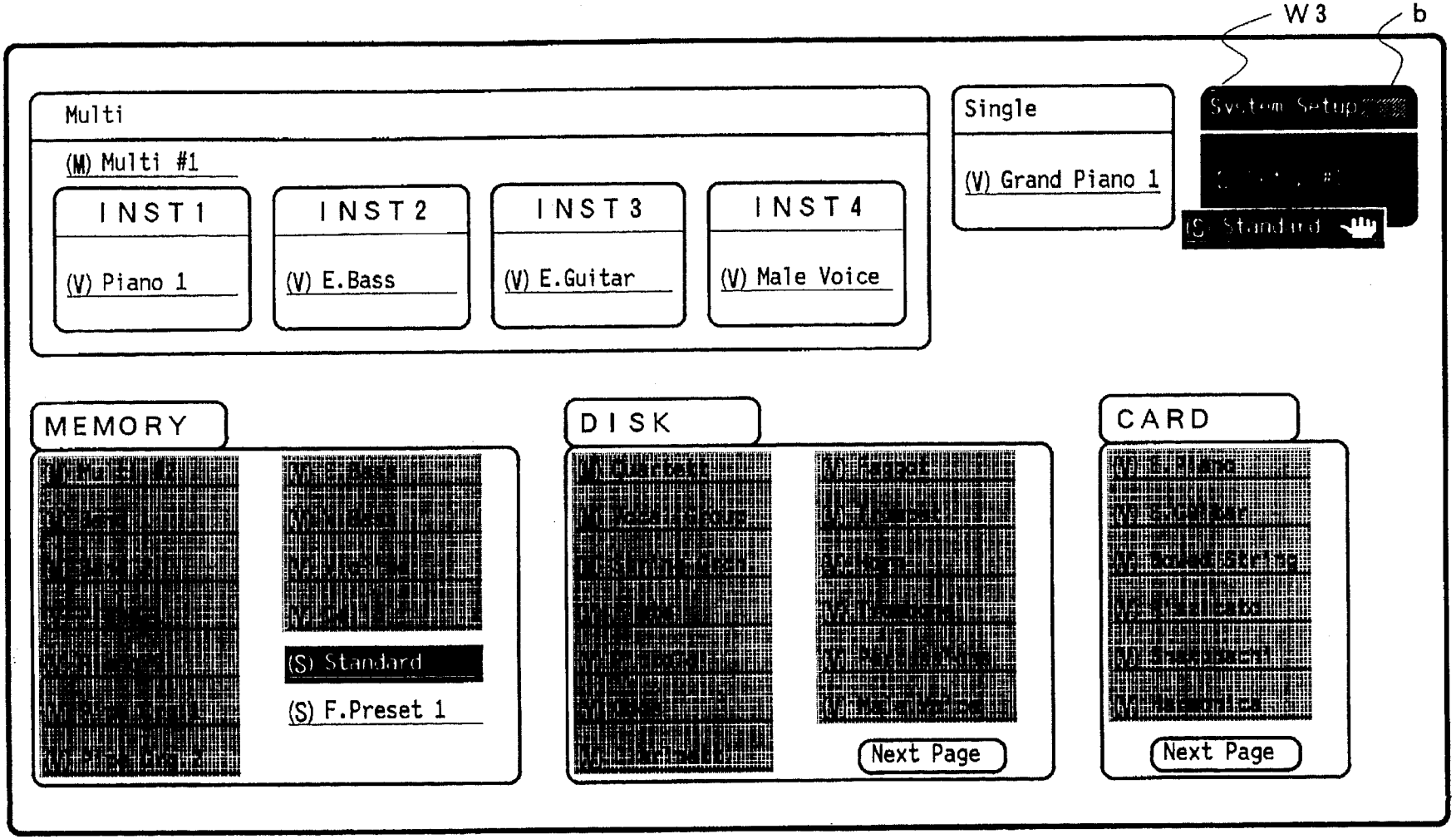
FIG. 9 is a diagram showing an example of display during data setting in the browser screen in the same embodiment.

In the browser function in the above described embodiment, it has merely been described that source data and destination data are designated and the source data is copied to the destination data. In the example of FIG. 9, for example, "Standard" is selected as the source data and "Setup #1" in the setup window W3 is designated as the destination data and the selected "Standard" data is copied as system setup data. In contrast to this example, description will now be made about an embodiment in which contents of processing is not limited to "data copy" but can be selected from among several types of candidates. Further, in the embodiment to be described below, a proper candidate among selectible candidates of processings is automatically shown in accordance with relation between the source data and the destination data.

Figure 16:
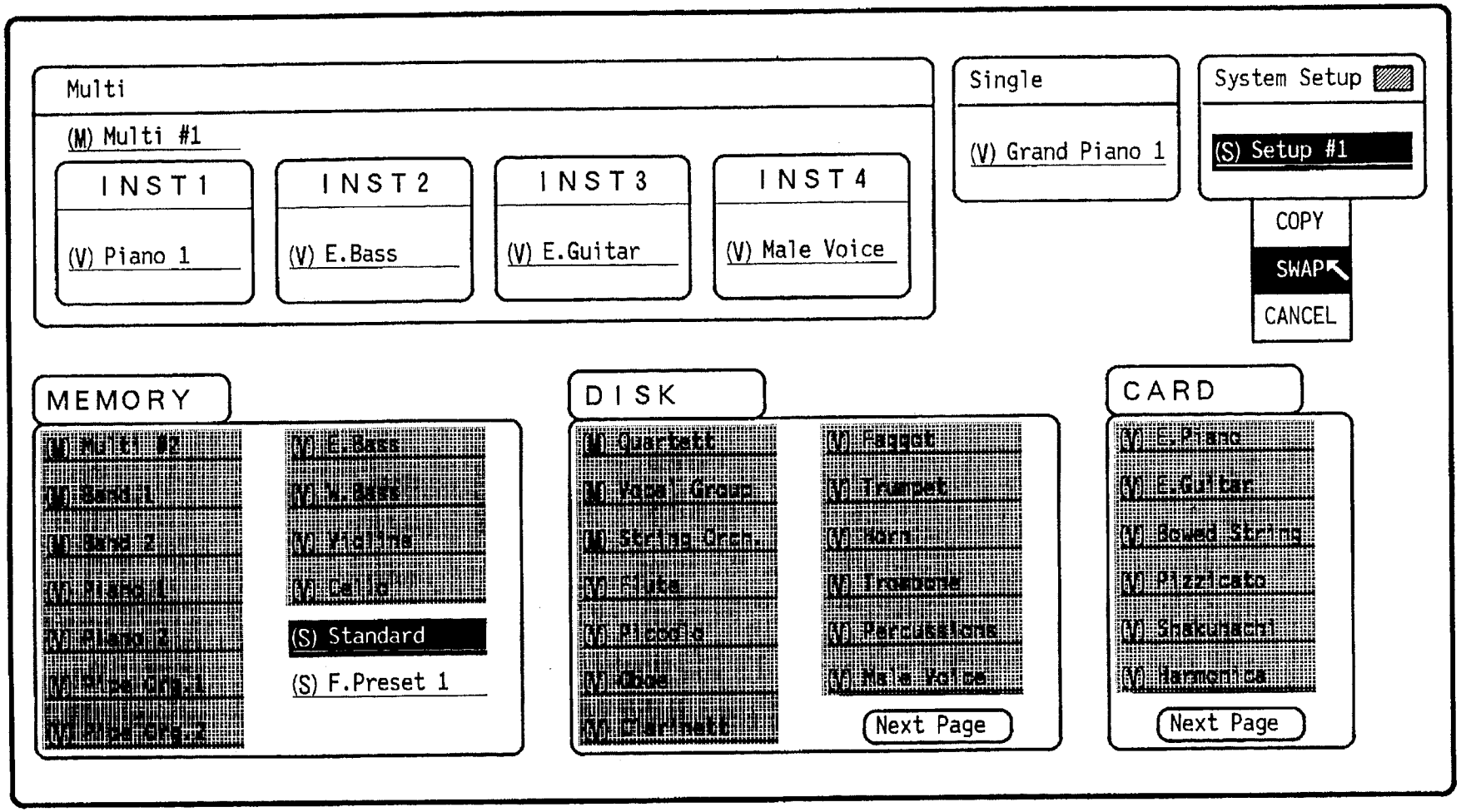
FIG. 16 is a diagram showing an example of display of a screen immediately after designation of destination data which is different from source data.
Figure 17:
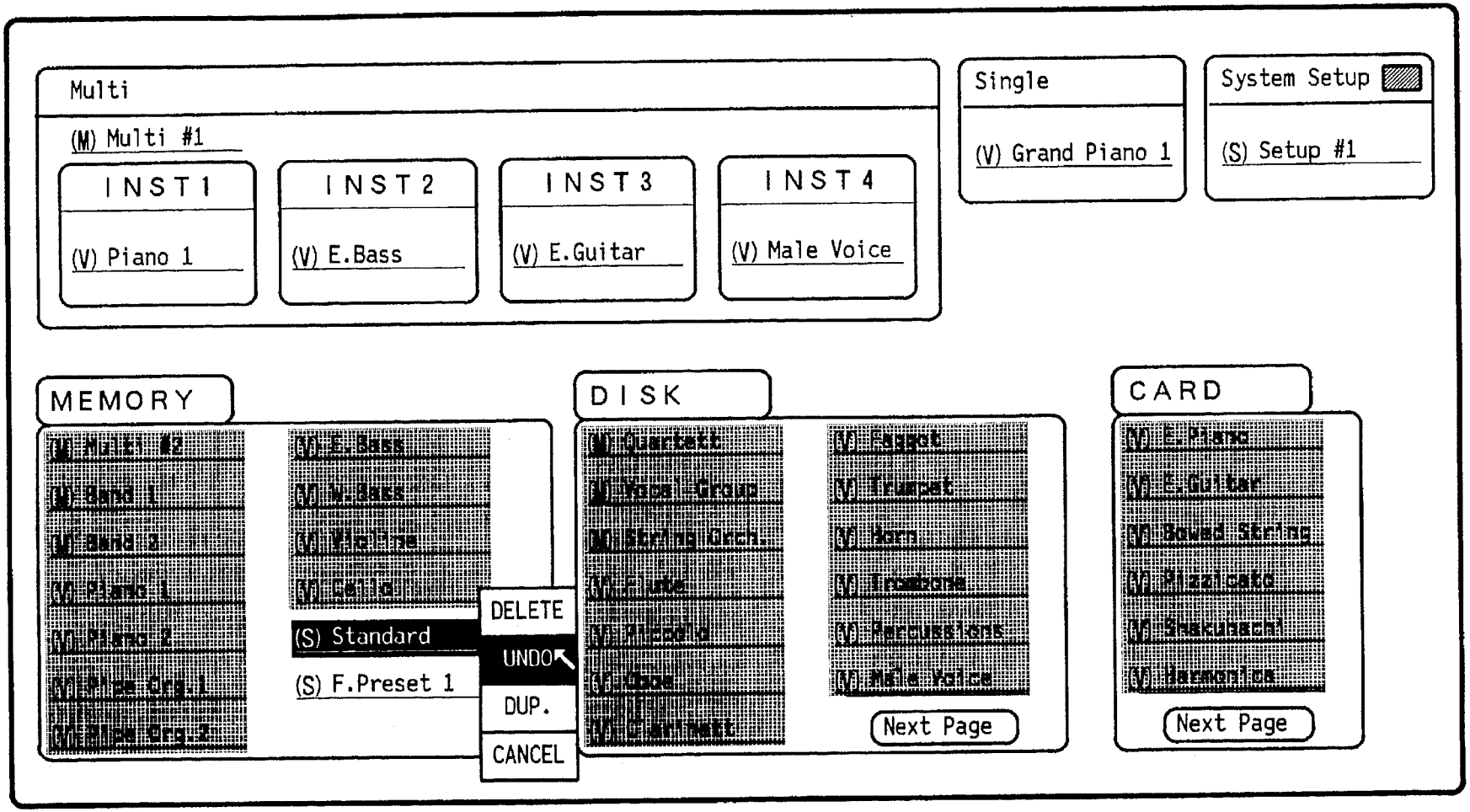
FIG. 17 is a diagram showing an example of display of a screen immediately after designation of destination data which is the same as source data.

In this embodiment, as shown in FIGS. 16 and 17, different pop-up menus are displayed depending upon the relation between the designated source data and destination data. Referring first to FIG. 16, this is an example of screen in a case where "Standard" of the window W4 is designated as the source data and "Setup #1" of the window W3 is designated as the destination data. In this case, the designated source data and destination data are mutually different data and, therefore, a pop-up menu presenting three types of processing menus of COPY, SWAP and CANCEL as candidates of subsequent processing menus is displayed in correspondence to the position of the pointer cursor.

At this time, the hand-shaped cursor is changed to the ordinary pointer cursor and, by moving this pointer cursor, a desired processing menu can be selected from among the menus of the pop-up menu and, by making a click on the mouse, this desired processing can be executed. In this example, when "COPY" is selected, the source data is copied to the destination data. When "SWAP" is selected, the source data and the destination data are exchanged. When "CANCEL" is selected, the preceding data processing is ignored and the routine returns to the ordinary screen as shown in FIG. 7. FIG. 16 shows a case where "SWAP" has been selected by the pointer cursor and this is invertedly displayed.

FIG. 17 shows an example of a screen in which "Standard" of the window W4 is selected as the source data as shown in FIG. 8 and then "Standard" of the same window W4 is designated as the destination data. There is a case, for example, where the cursor is dragged after designation of source data and then is returned to the original position to designate the same data as destination data, or where the click switch is released without dragging of the cursor at all. In this case, since the designated source data and destination data are entireley the same, there is no sense in performing the above described "COPY" or "SWAP" as subsequent processing menu. Therefore, a pop-up menu presenting DELETE, UNDO, DUP. and CANCEL as selectibie processing menus is displayed at the cursor position.

At this time, the hand-shaped cursor is changed to the ordinary pointer cursor and, by selecting a desired processing menu from among the processing menus of the pop-up menu and, by making a click on the mouse, the desired processing can be executed. In this example, when "DELETE" is selected, the source data is cancelled. When "UNDO" is selected, the screen returns to one for selecting th destination data. When "DUP." is selected, the setup parameter "(S) Standard" is duplicated. When "CANCEL" is selected, the preceding data selection processing is ignored and the screen returns to the ordinary screen shown in FIG. 7. FIG. 17 shows a case where "UNDO" is selected by the pointer cursor and this is invertedly displayed.

Figure 18:
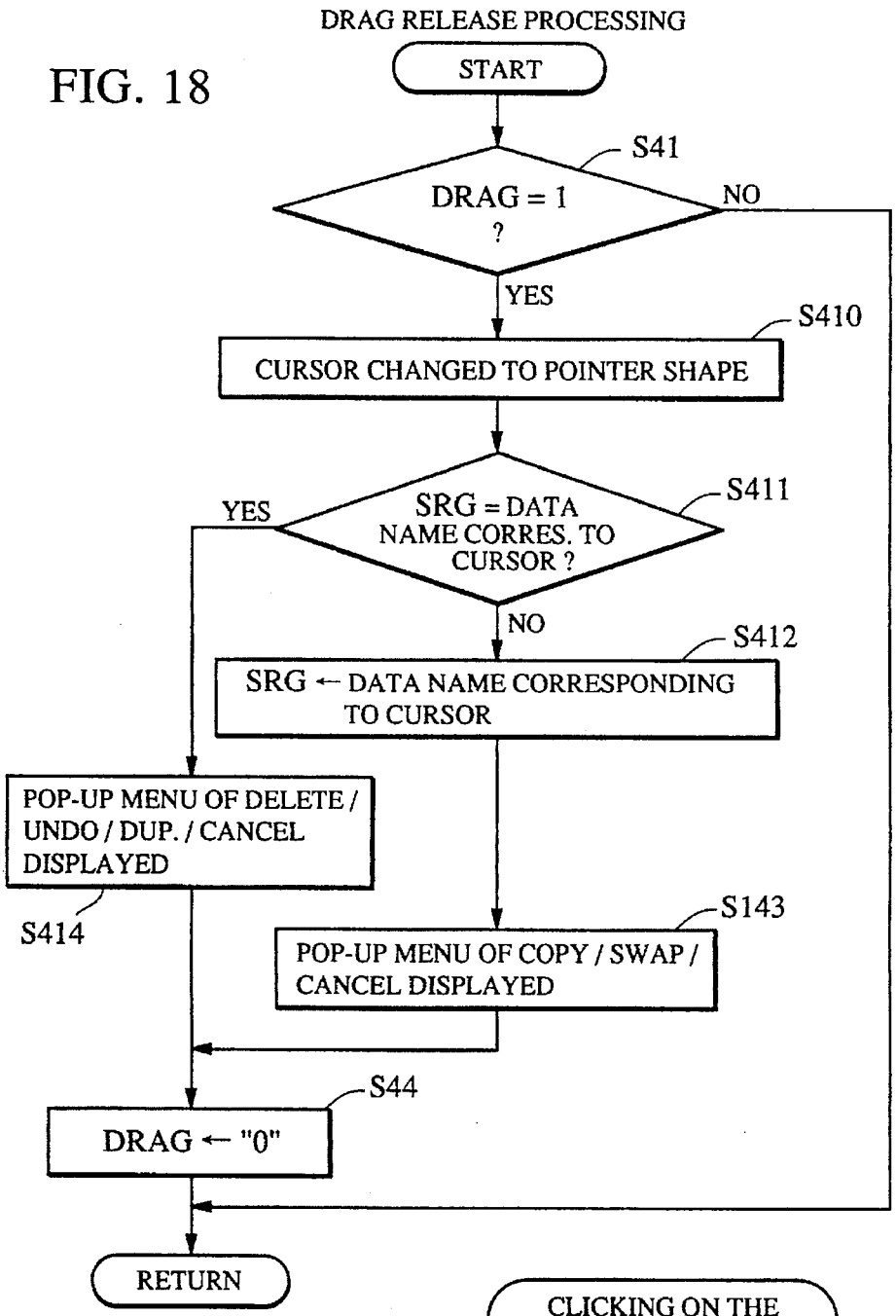
FIG. 18 is a flow chart showing a drag release processing in a modified embodiment.

For performing the processings of FIGS. 16 and 17, the drag release processing shown in FIG. 14 should preferably be changed to one shown in FIG. 18.

The drag release processing shown in FIG. 18 is performed when, as described before, the click switch of the mouse is OFF event. First, in step S41, whether or not the flag DRAG is "1", i.e., whether or not dragging has heretofore been made, is examined. When the result is YES, the routine proceeds to step S410 in which the hand-shaped cursor is changed to the ordinary pointer cursor. Then, in next step S411, whether or not the data name corresponding to the current pointer cursor coincides with the source data name stored in the source register SRG is examined. That is, whether or not the designated destination data coincides with the source data is examined. When the result is NO, the routine proceeds to step S412 in which the data name corresponding to the current pointer cursor position is stored in a destination register DRG. In next step S413, the source data is different from the destination data, a pop-up menu consisting of COPY, SWAP and CANCEL as shown in FIG. 16 is displayed at the cursor position. Then, the routine proceeds to step S44 in which the flag DRAG is reset to "0".

On the other hand, when the source data and the destination data are the same, the routine proceeds from YES of step S411 to step S414 in which the pop-up menu consisting of DELETE, UNDO, DUP. and CANCEL as shown in FIG. 17 is displayed in correspondence to the cursor position. Thereafter, the routine proceeds to step S44.

Figure 19:
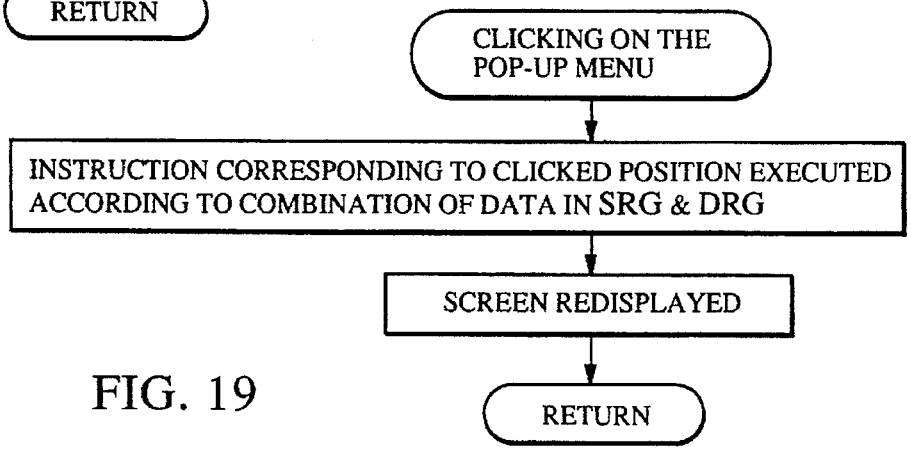
FIG. 19 is a flow chart showing an example of a processing which is executed when a click switch of a mouse cursor is switched on in the pop-up menu shown in FIG. 16 or 17 in the modified embodiment.

FIG. 19 shows an example of processing performed when a click is made on the mouse cursor on the pop-up menu as shown in FIG. 16 or 17. In this processing, an instruction corresponding to the processing menu at the position where the click has been made is executed in accordance with contents of the source data name stored in the source register SRG and the destination data name stored in the destination register DRG and redisplay of the screen is made in accordance with the data name after the execution of this instruction. When, for example, a click has been made on the swap (SWAP) in the state of FIG. 16, the setup parameter "(S) Setup #1" in the setup window System Setup is set at "(S) Standard" and setup parameter "(S) Standard" in the memory window MEMORY is set at "(S) Setup #1" whereby the two parameters are exchanged.

By performing automatically an operation corresponding to the selected number of data or selected type of data as described above, the operation can be performed accurately and at a high speed without forcing the operator to perform a complicated mode selection.

In the above described embodiment, description has been made about a case where data is processed in the screen on which a data name such as multiple parameter or voice parameter is displayed. Data processing may also be made in a graphic display screen on which, as shown in FIG. 20, parameters are displayed visually.

Figure 20:
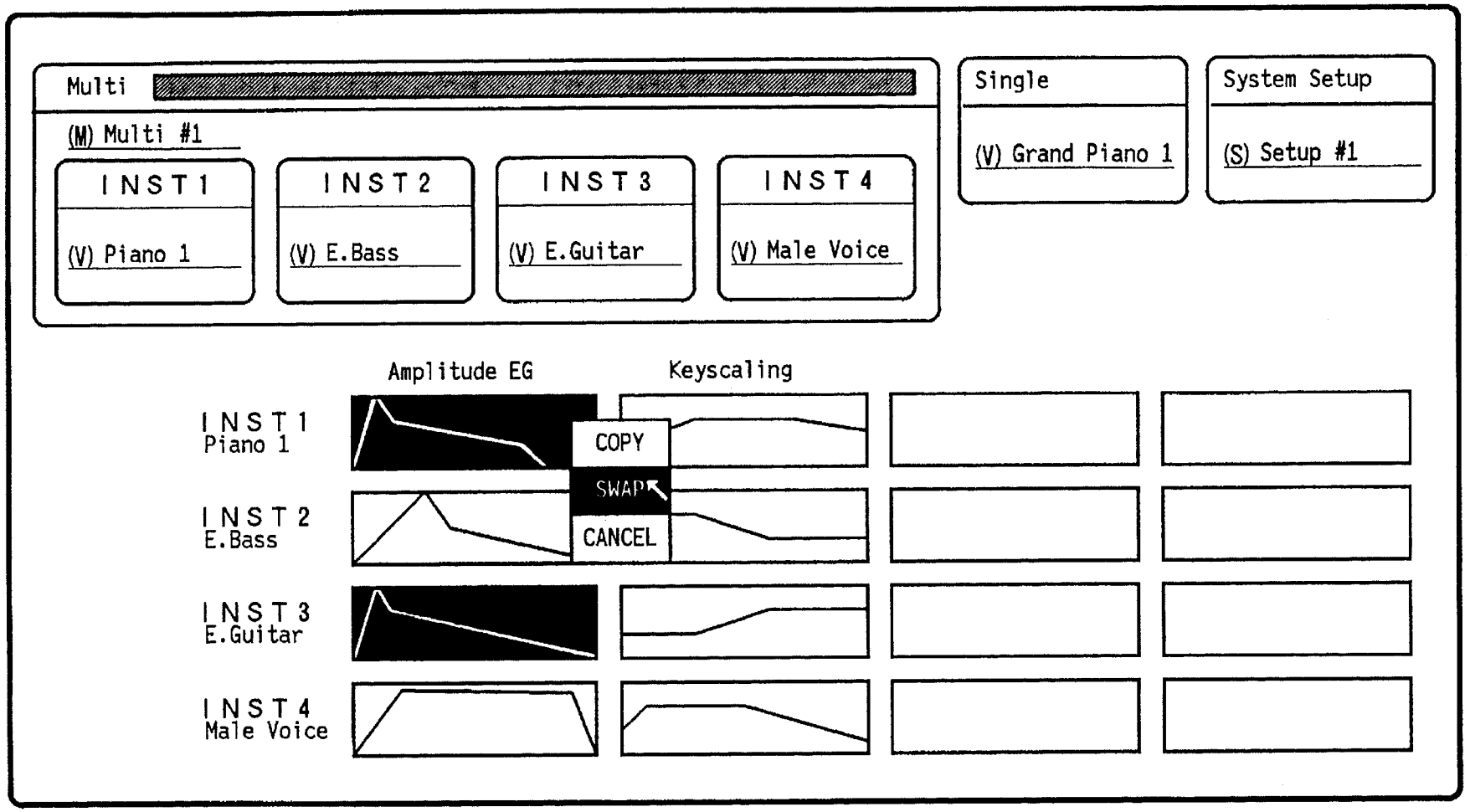
FIG. 20 is a diagram showing an example of display of a screen when a data editing processing is made on a graphic display screen displaying parameters visually in another modified embodiment.

In the example of FIG. 20, data contents of amplitude envelope and key scaling which constitue voice parameters set in the four musical instrument windows INST1–INST4 are graphic displayed and data copying (COPY), data exchange (SWAP) and data deletion (DELETE) can be made between respective data in the same manner as in the previously described embodiment. FIG. 20 shows a case where the data exchange (SWAP) processing is designated by using the amplitude envelope of the third window INST3 as source data and the amplitude envelope of the first window INST1 as destination data.

Figure 21:
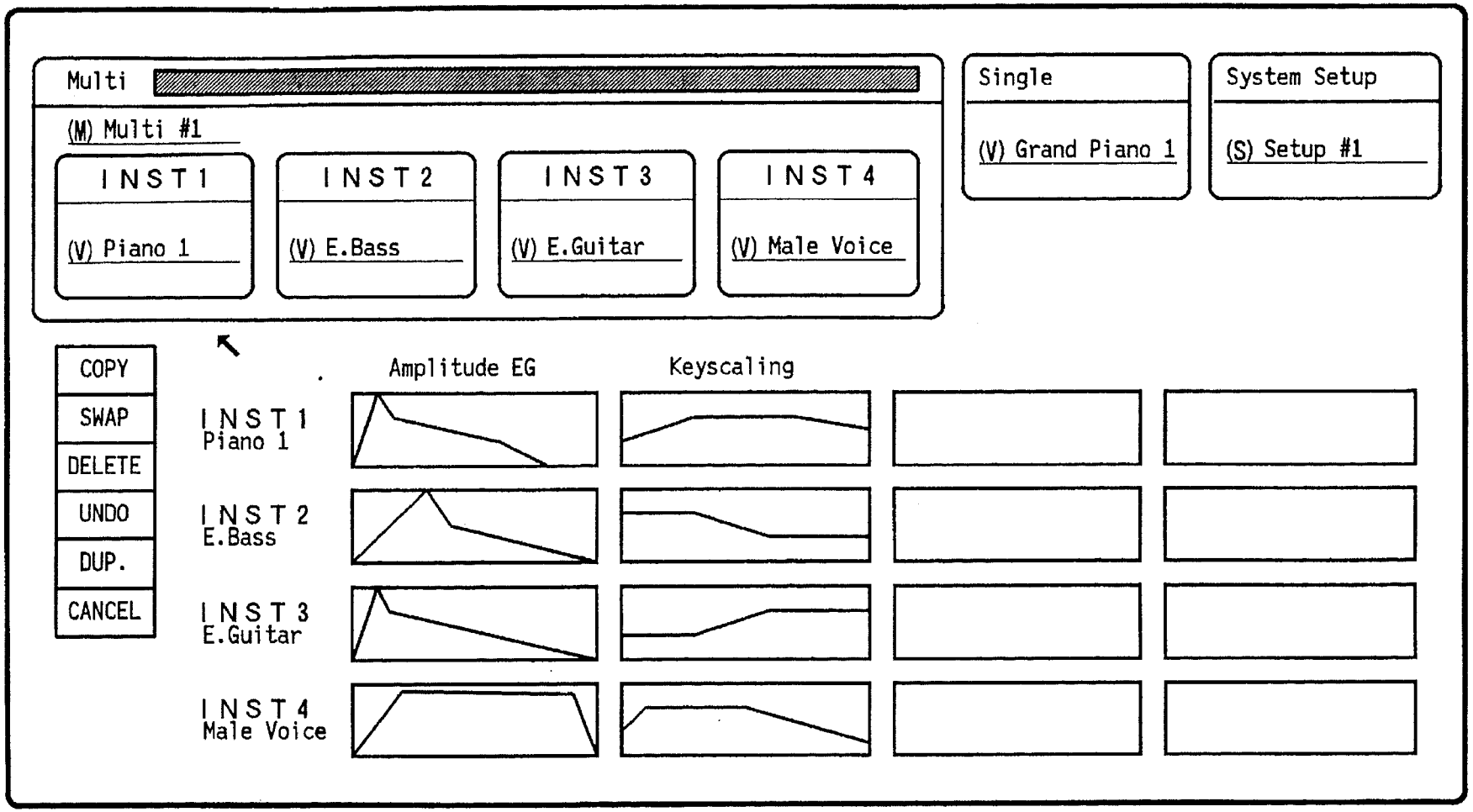
FIG. 21 is a diagram showing an example of display of a screen on which, in still another embodimen of the invention, availabel menus are displayed and different processings can be made continuously by previously designating the processings.

FIG. 21 shows a case where the pop-up menu which is displayed after designation of source data and destination data in the previous embodiment is previously displayed on the screen. In a case where it is known that copying must be made continuously, it is troublesome to have the pop-up menu displayed after designating source data and destination data and then select a copying processing. In FIG. 21, therefore, processing menus available for use are previously displayed on the screen and, by first designating contents of processing, the copying processing can be made continuously. This enables a player who is not well acquainted with operation of the apparatus of the present embodiment to carry out the editing operation easily. A switch may be provided on the switch operation panel or in a part of the display screen for switching the mode in which processing menus are previously displayed as in the present embodiment and the mode in which the pop-up menu is displayed after designation of data as in the previously described embodiment.

In the above described embodiments, description about the manner of moving the mouse cursor has been made about the case where the mouse is dragged while the click swich is maintained in the on state. The manner of moving the mouse cursor is not limited to this but other method of moving the mouse cursor may be used. Also, in the above described embodiments, designation of destination data is made during dragging release, i.e., when the click switch has been turned off during drgging. The designation of destination data however is not limited to this. For example, designation of destination data may be made in response to a first click ON event after the source data has been designated. In this case, a step of detecting two consecutive depression of the click switch should preferably be provided so that, when the two consecutive depression has been detected, the processing of step S414 of FIG. 18 may be performed to have the pop-up menu shown in FIG. 17 displayed.

In the above described embodiments, the mouse is used as the pointing device. The pointing device however is not limited to the mouse but other devices such as a cursor switch, an electronic pen and a track ball may be employed.

As described in the foregoing, according to the invention, in an electronic musical instrument capable of setting and changing a tone characteristic by editing sound parameters for elements of a musical tone, an outline, showing structure of a tone source system is constantly displayed on a display screen during a sound parameter editing mode and a portion indicating an element which is the object of editing of the sound parameters is emphatically displayed and, accordingly, the tone source system and the element which is the object of editing can be readily recognized during the editing of the sound parameters whereby the editing of the sound parameters can be facilitated. Moreover, according to the invention, when parameters in an electronic musical instrument or the like device are edited, an editing operation based on the player's feeling occurring in the process of thinking can be realized.

What is claimed is:

1. A sound parameter editing device for an electronic musical instrument comprising:

a display device;

editing means for selecting an element from a plurality of elements for producing a sound, and for editing at least one sound parameter associated with the selected element, each said element including a plurality of independently editable function blocks each having at least one sound parameter associated therewith; and display control means for controlling said display device so that, when the at least one sound parameter of the selected element is being edited, an elements schematic display of all elements for producing the sound is displayed, a particular portion of the elements schematic display corresponding to the selected element being displayed in a manner emphasizing the selected element, wherein a detailed display of all the function blocks corresponding to the selected element are concurrently displayed on the display device.

2. A device as defined in claim 1 wherein said editing means further includes means for selecting one of said function blocks of said detailed display of all the function blocks corresponding to the selected element and for editing at least one parameter associated with the selected function block, and said display control means further includes means for controlling said display device so that, when the at least one parameter associated with the selected function block is being edited, a function blocks schematic display of the function blocks corresponding to the selected element is displayed and a particular portion of the function blocks schematic display corresponding to the selected function block is displayed in a manner emphasizing the selected function block.

3. A device as defined in claim 1 wherein said elements for producing a sound correspond to elements of a tone source circuit of the electronic musical instrument.

4. A device as defined in claim 1 wherein said elements for producing a sound comprise at least one of an input circuit, a tone generator, and a mixer circuit.

5. A device as defined in claim 1 wherein said elements for producing a sound comprise an input circuit, at least one tone generator, and a mixer circuit.

6. A device as defined in claim 2 wherein said display control means further includes means for displaying a detailed display of said at least one parameter associated with the selected function block concurrently with said elements schematic display and said function blocks schematic display.

7. A data editing device for an electronic musical instrument comprising:

designation means for designating an object of to be edited;

display means for displaying a plurality of editing operations corresponding to the designated object, wherein the plurality of displayed editing operations is less than a total number of editing operations performable by said data editing device;

selection means for selecting one of the displayed editing operations; and execution means for executing the selected editing operation with respect to said designated object.

8. A device as defined in claim 7 wherein said plurality of editing operations include an operation for copying parameter data from a first designated object to a second designated object and an operation for exchanging parameter data.

9. A device as defined in claim 7 further comprising a display screen for displaying a plurality of objects, said designation means designating at least one desired object from said plurality of objects displayed on said display screen, and said display means displaying editing operations associated with said at least one designated object in a pop-up display in the vicinity of the at least one designated object on said display screen.

10. A device as defined in claim 8 wherein said designation means further includes means for designating said first object as a source object, and wherein said display means further includes means for displaying said second object in a distinctive manner to indicate whether said parameter data can be copied from said first object to said second object.

11. A data editing device for an electronic musical instrument comprising:

means for designating a source object to be edited;

means for designating a destination object to be edited;

means for listing a plurality of editing operations in accordance with combinations of the designated source and destination objects;

selection means for selecting one of the the plurality of editing operations; and execution means for executing the selected editing operation with respect to the designated objects.

12. A parameter editing device for an electronic musical instrument comprising:

components displaying means for displaying a plurality of sound producing components of said electronic musical instrument;

component selecting means for selecting one of said displayed components;

elements displaying means, responsive to selection of one of said displayed components, for displaying elements composing said selected component;

element selecting means for selecting one of said displayed elements;

function blocks displaying means, responsive to selection of one of said displayed elements, for displaying function blocks composing said selected element and simultaneously displaying an elements schematic display of said elements composing said selected sound producing component with said selected element displayed in an emphasized manner;

first editing means for editing at least one parameter associated with said selected element;

function block selecting means for selecting one of said displayed function blocks; and parameter displaying means, responsive to selection of one of said displayed function blocks, for displaying at least one parameter associated with said selected function block, simultaneously displaying said elements schematic with said selected element displayed in an emphasized manner, and simultaneously displaying a function blocks schematic of said function blocks composing said selected element with said selected function block displayed in an emphasized manner.

13. A device as defined in claim 12 wherein said device further comprises:

second editing means for editing said at least one parameter associated with said selected function block.

14. A method for editing parameters associated with a sound producing component of an electronic musical instrument comprising:

displaying a plurality of sound producing components of said electronic musical instrument;

selecting one of said displayed components;

displaying elements composing said selected sound producing component;

selecting one of said displayed elements;

displaying function blocks composing said selected element and simultaneously displaying said elements representing said sound producing component with said selected component displayed in an emphasized manner;

allowing at least one parameter associated with said selected element to be edited;

receiving a selection of one of said displayed function blocks;

displaying at least one parameter associated with said selected function block, simultaneously displaying said elements representing said sound producing component with said selected element displayed in an emphasized manner, and simultaneously displaying said function blocks that compose said selected element with said selected function block displayed in an emphasized manner.

15. The method of claim 14 further comprising the step of:

allowing said at least one parameter associated with said selected function block to be edited.

16. A media for use in an electronic musical instrument comprising a processing unit and a display device, said media containing program code executable by said processing unit for performing the steps of:

displaying a plurality of sound producing components of said electronic musical instrument on said display device;

selecting one of said displayed components;

displaying elements composing said selected sound producing component on said display device;

selecting one of said displayed elements;

displaying on said display device function blocks composing said selected element and simultaneously displaying on said display device said elements representing said sound producing component with said selected component displayed in an emphasized manner;

allowing at least one parameter associated with said selected element to be edited;

receiving a selection of one of said displayed function blocks; and displaying on said display device at least one parameter associated with said selected function block, simultaneously displaying on said display device said elements representing said sound producing component with said selected element displayed in an emphasized manner, and simultaneously displaying on said display device said function blocks that compose said selected element with said selected function block displayed in an emphasized manner.

17. The media of claim 16, wherein said steps further comprise allowing said at least one parameter associated with said selected function block to be edited.

* * * * *